US011521788B2

(12) United States Patent
Hidaka

(10) Patent No.: US 11,521,788 B2
(45) Date of Patent: Dec. 6, 2022

(54) INDUCTOR AND TRANSFORMER

(71) Applicant: Murata Manufacturing Co., Ltd., Kyoto-fu (JP)

(72) Inventor: Seiji Hidaka, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 485 days.

(21) Appl. No.: 16/842,713

(22) Filed: Apr. 7, 2020

(65) Prior Publication Data

US 2020/0234871 A1 Jul. 23, 2020

Related U.S. Application Data

(63) Continuation of application No. PCT/JP2018/042929, filed on Nov. 21, 2018.

(30) Foreign Application Priority Data

Nov. 28, 2017 (JP) ..... JP2017-228400

(51) Int. Cl.
*H01F 27/28* (2006.01)
*H01F 27/29* (2006.01)

(52) U.S. Cl.
CPC ..... *H01F 27/2823* (2013.01); *H01F 27/29* (2013.01); *H01F 2027/2838* (2013.01)

(58) Field of Classification Search
CPC ..... H01F 17/0013; H01F 27/2804; H01F 2027/2809; H01F 17/0006; H01F 5/003; H01F 27/29; H01F 27/292; H01F 27/2823
USPC ..... 336/200, 232
See application file for complete search history.

(56) References Cited

U.S. PATENT DOCUMENTS 5,770,991 A * 6/1998 Baird ..... H01F 41/063 336/83
6,169,470 B1 * 1/2001 Ibata ..... H01F 17/0006 336/200
7,701,036 B2 * 4/2010 Lee ..... H01L 23/5227 257/E21.022

(Continued)

FOREIGN PATENT DOCUMENTS

JP 2006-339617 A 12/2006
JP 2009-503909 A 1/2009

(Continued)

OTHER PUBLICATIONS

International Search Report issued in PCT/JP2018/042929; dated Jan. 15, 2019.

(Continued)

*Primary Examiner* — Tszfung J Chan
(74) *Attorney, Agent, or Firm* — Studebaker & Brackett PC

(57) ABSTRACT

An inductor includes a plurality of wires disposed about an axis, a first electrode connected to a first end of each of the plurality of wires, and a second electrode connected to a second end of each of the plurality of wires. Each of the wires includes an outer-winding helical portion shifting in an axial direction while gradually increasing a radius thereof, an inner-winding helical portion shifting in the axial direction while gradually reducing a radius thereof, and an outer circumference connection portion that connects an end of the outer-winding helical portion and an end of the inner-winding helical portion at different positions in the axial direction.

20 Claims, 26 Drawing Sheets

(56) References Cited

U.S. PATENT DOCUMENTS

| | | | | |
|---|---|---|---|---|
| 7,830,237 | B1 | 11/2010 | Chen | |
| 2009/0256668 | A1* | 10/2009 | Noma | H01F 17/0013 336/200 |

FOREIGN PATENT DOCUMENTS

| | | | |
|---|---|---|---|
| JP | 2010-147043 | A | 7/2010 |
| JP | 2011-103439 | A | 5/2011 |
| JP | 2011-187600 | A | 9/2011 |
| JP | 2014-053397 | A | 3/2014 |
| JP | 2015-188033 | A | 10/2015 |

OTHER PUBLICATIONS

Written Opinion issued in PCT/JP2018/042929; dated Jan. 15, 2019.

* cited by examiner

| MODEL | NUMBER OF LINES | LINE WIDTH a | PITCH b |
|---|---|---|---|
| A | 5x5 | 11 | 22 |
| B | 10x10 | 5.3 | 10.6 |
| C | 20x20 | 2.6 | 5.2 |
| D | 40x40 | 1.3 | 2.6 |

UNIT [μm]

INDUCTOR AND TRANSFORMER

CROSS-REFERENCE TO RELATED APPLICATIONS

This application claims benefit of priority to International Patent Application No. PCT/JP2018/042929, filed Nov. 21, 2018, and to Japanese Patent Application No. 2017-228400, filed Nov. 28, 2017, the entire contents of each are incorporated herein by reference.

BACKGROUND

Technical Field

The present disclosure relates to an inductor including multiple coaxially wound wires and a transformer including the inductor, and particularly to a technology of reducing a loss in an inductor and a transformer.

Background Art

Inductors including multiple coaxially wound wires are known, as described, for example, in Japanese Unexamined Patent Application Publication No. 2011-187600 and Japanese Unexamined Patent Application Publication No. 2015-188033.

Inductors disclosed in Japanese Unexamined Patent Application Publication No. 2011-187600 and Japanese Unexamined Patent Application Publication No. 2015-188033 each include conductors with a small diameter or thickness for use as individual wires to reduce the skin effect on high-frequency signals. While being coiled, a wire disposed on the inner circumference and a wire disposed on the outer circumference are switched with each other, that is, the wires are reversed in the arrangement order in the radial direction to uniformize the wire length (specifically, wire resistance) and uniformize current distribution of wires.

SUMMARY

In the inductors of Japanese Unexamined Patent Application Publication No. 2011-187600 and Japanese Unexamined Patent Application Publication No. 2015-188033, however, the order in which the wires are arranged in the radial direction is simply reversed to uniformize the wire length. Thus, the wires located in the middle portion in the radial direction are never exposed to the inner circumference or the outer circumference, and the wires at the inner circumference or the outer circumference are never located in the middle portion in the radial direction. Thus, the wires fail to have precisely uniform wire length, and may have an imbalance in current distribution in the wires. The imbalance in current distribution in the wires can cause joule loss due to alternating current.

The present disclosure provides a low-loss inductor including multiple coaxially wound wires and reducing an imbalance in current distribution in the wires.

Therefore, an inductor according to an aspect of the present disclosure includes a plurality of wires disposed about an axis, a first electrode connected to a first end of each of the plurality of wires, and a second electrode connected to a second end of each of the plurality of wires. Each of the plurality of wires includes an outer-winding helical portion, an inner-winding helical portion, and a connection portion. The outer-winding helical portion shifts in an axial direction while gradually increasing a radius thereof. The inner-winding helical portion shifts in the axial direction while gradually reducing a radius thereof. The connection portion connects an end of the outer-winding helical portion and an end of the inner-winding helical portion at positions different in the axial direction.

A transformer according to an aspect of the present disclosure includes a plurality of inductors magnetically coupled to each other, the inductors each being the above-described inductor.

According to the present disclosure, a low-loss inductor that reduces an imbalance in current distribution in wires and a low-loss and highly efficient transformer including the inductor can be obtained.

DETAILED DESCRIPTION

Embodiments of the present disclosure will be described below in detail with reference to the drawings. Embodiments described below are comprehensive and specific examples. The numerical values, shapes, materials, components, arrangements of the components, forms of connection, and others described in the following embodiments are mere examples and not intended to limit the present disclosure. Components of the following embodiments not described in independent claims are described as optional components.

Embodiment 1

An inductor according to Embodiment 1 is an inductor including multiple coaxially wound wires, and has a characteristic wire structure for reducing an imbalance in current distribution between the wires.

(Entire Structure of Inductor)

Figure 1:
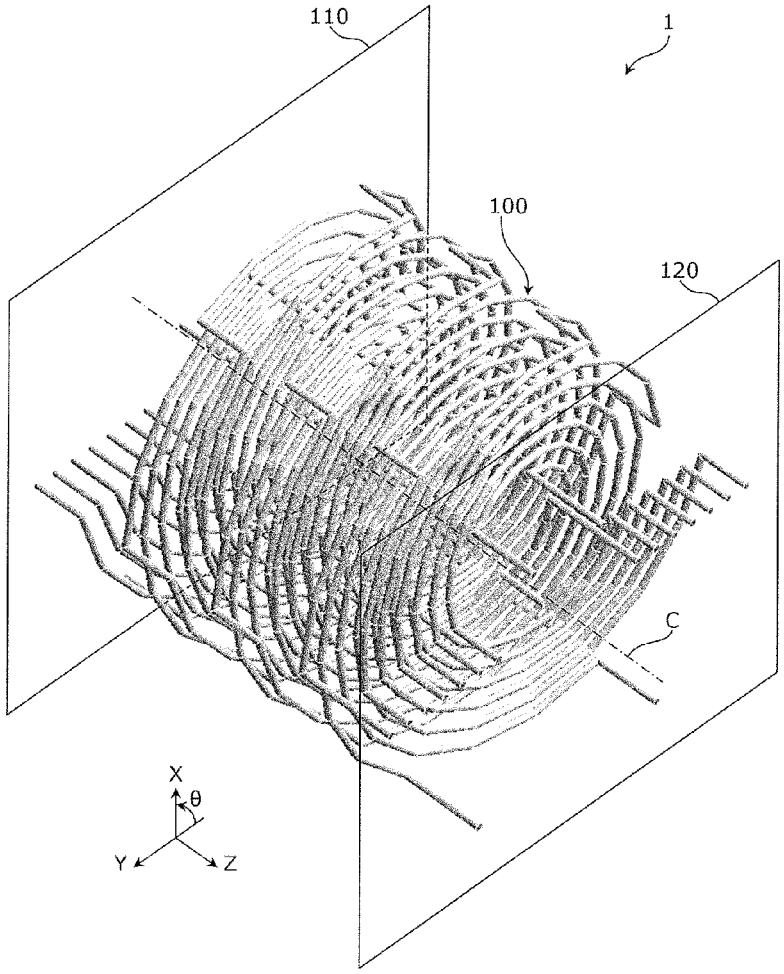
FIG. 1 is a perspective view of an example of a structure of an inductor according to Embodiment 1.

FIG. 1 is a schematic perspective view of the entire structure of the inductor according to Embodiment 1.

As illustrated in FIG. 1, an inductor 1 includes multiple wires 100, a first electrode 110, and a second electrode 120. The multiple wires 100 are disposed about an axis C. The first electrode 110 is connected to a first end of each of the multiple wires 100. The second electrode 120 is connected to a second end of each of the multiple wires 100. Thus, the inductor 1 forms a two-terminal inductor element.

Herein, the direction in which the axis C extends may be referred to as an axial direction, and the circumferential direction about the axis C may be referred to as a direction around the axis or a circumferential direction. For illustration convenience, the position in the axial direction is represented with a Z coordinate that increases from the first electrode 110 toward the second electrode 120. The position in the circumferential direction is represented with an angle θ that increases clockwise when viewed in the Z-axis direction, with the negative direction of the Y-axis defined as 0°.

As an example of the dimensions of the inductor 1, the wire width is 2 μm, the pitch in the radial direction (inter-core distance of wires adjacent to each other in the radial direction) is 6 μm, the pitch in the axial direction (inter-core distance of wires adjacent to each other in the axial direction) is 10 μm, and the coil diameter is 120 μm. The method for manufacturing the inductor 1 is not limited to a particular one, but may be manufactured by, for example, using a metal 3D printer.

(Shape of Wires)

Figure 2:
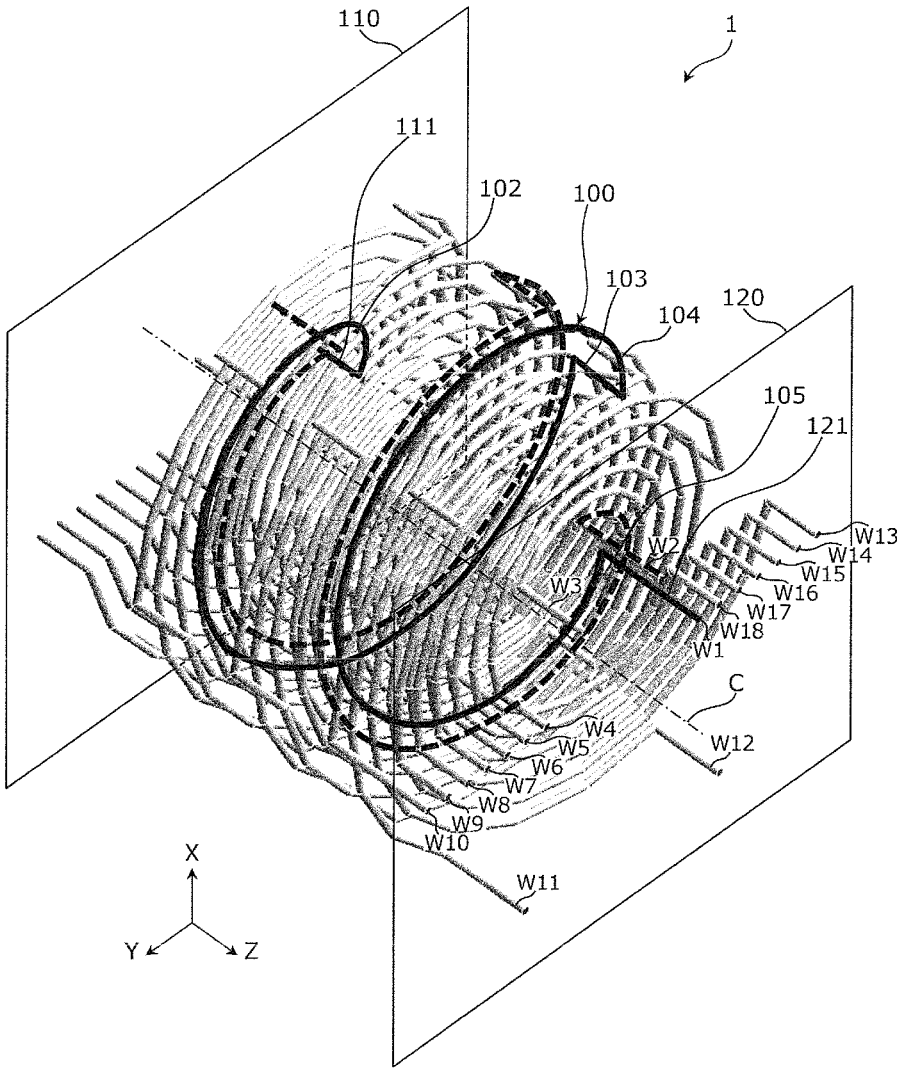
FIG. 2 is a perspective view of an example of the shapes of wires according to Embodiment 1.

FIG. 2 is a perspective view of an example of the shapes of the wires 100 included in the inductor 1.

As illustrated in FIG. 2, the inductor 1 includes 18 wires 100 denoted with reference signs W1 to W18. Each of the wires 100 has two turns. FIG. 2 illustrates the wires W1 and W2 with a thick solid line and a thick broken line for exaggeration, respectively, to clarify the specific examples of the shapes.

Figure 3:
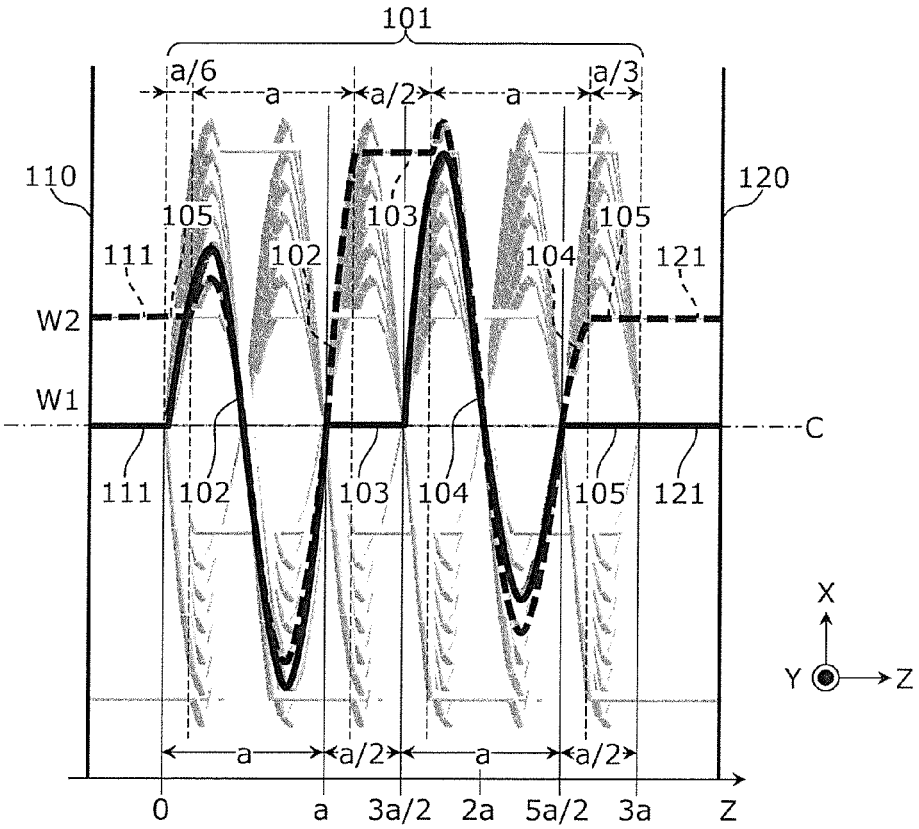
FIG. 3 is a side view of an example of the shapes of the wires according to Embodiment 1.
Figure 4:
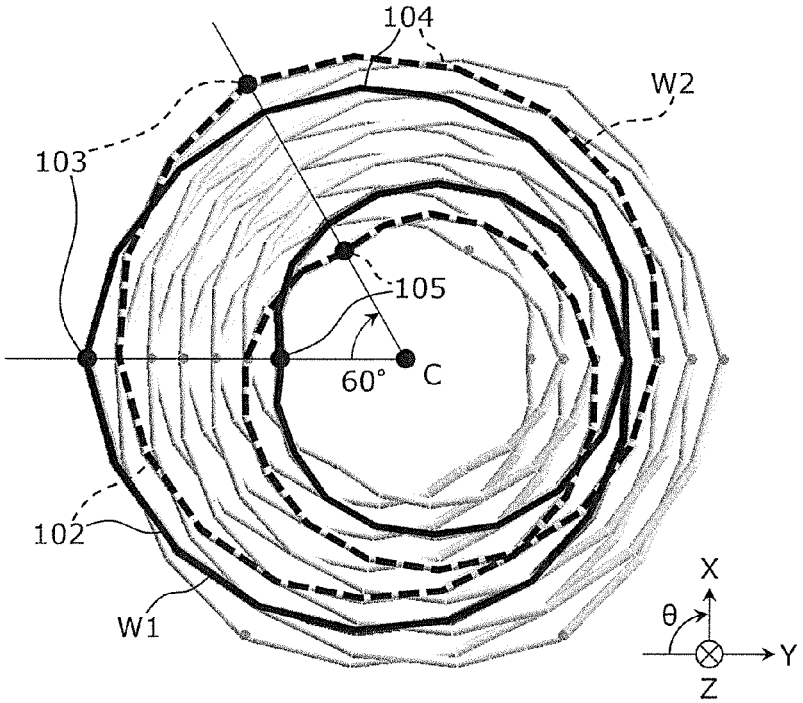
FIG. 4 is a front view of an example of the shapes of the wires according to Embodiment 1.
Figure 5A:
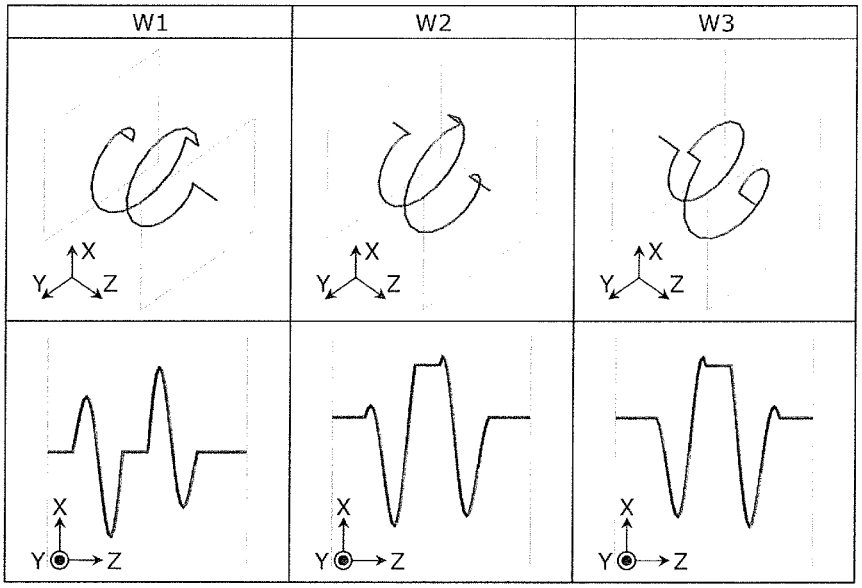
FIG. 5A includes perspective views and side views of examples of the wire shapes according to Embodiment 1.
Figure 5B:
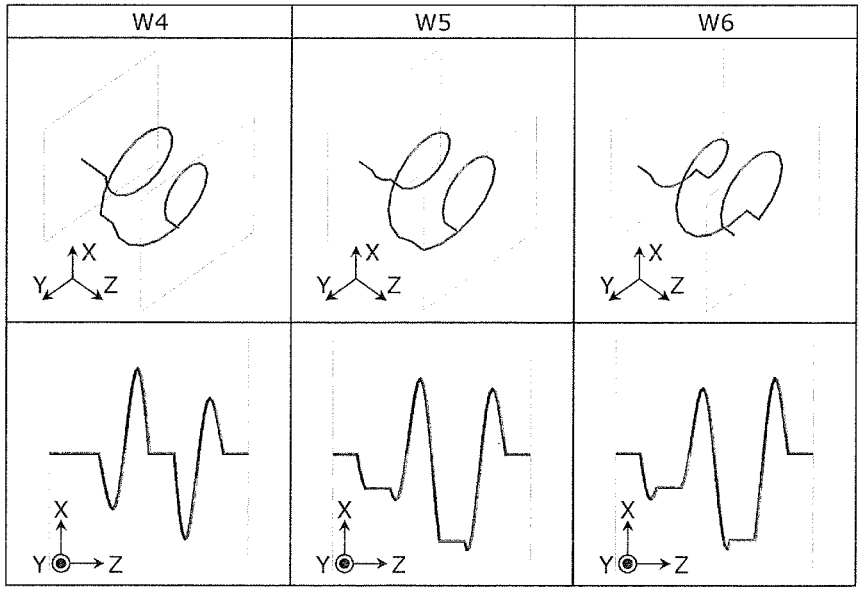
FIG. 5B includes perspective views and side views of examples of the wire shapes according to Embodiment 1.
Figure 5C:
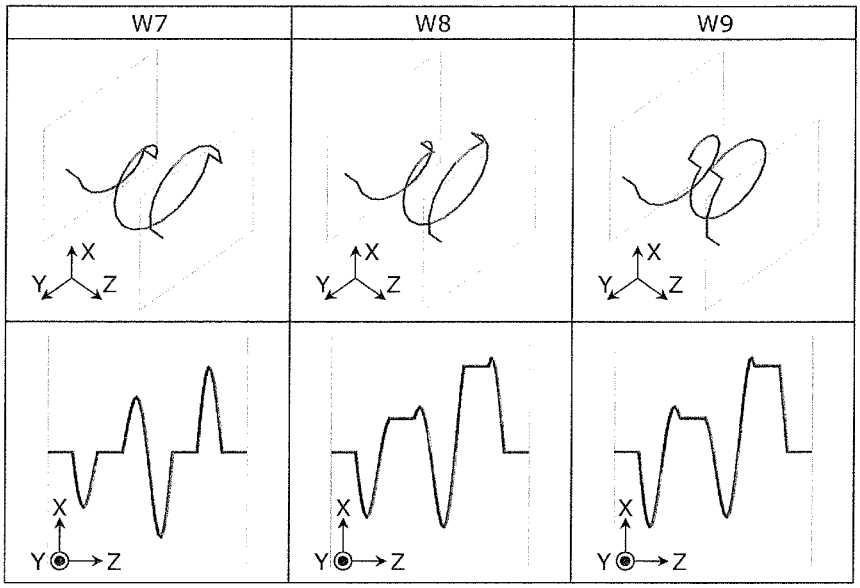
FIG. 5C includes perspective views and side views of examples of the wire shapes according to Embodiment 1.
Figure 5D:
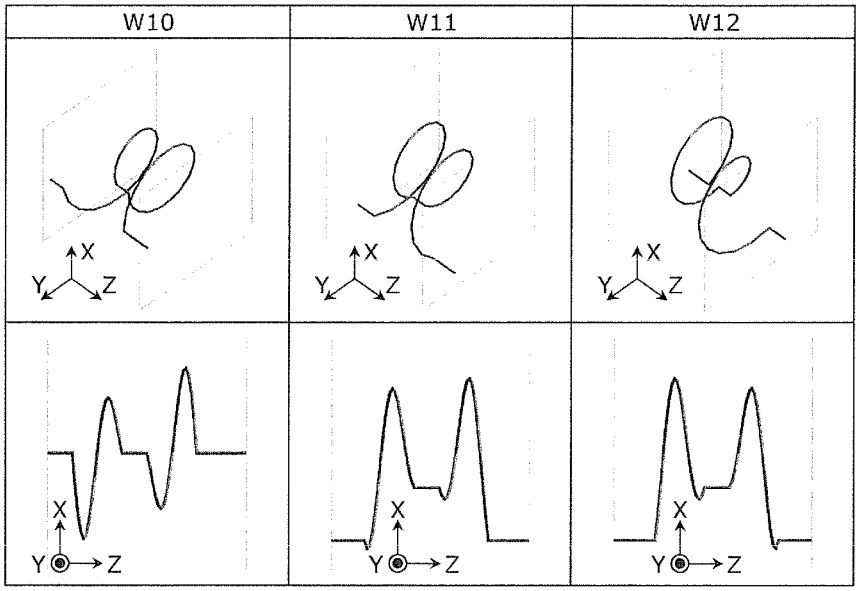
FIG. 5D includes perspective views and side views of examples of the wire shapes according to Embodiment 1.
Figure 5E:
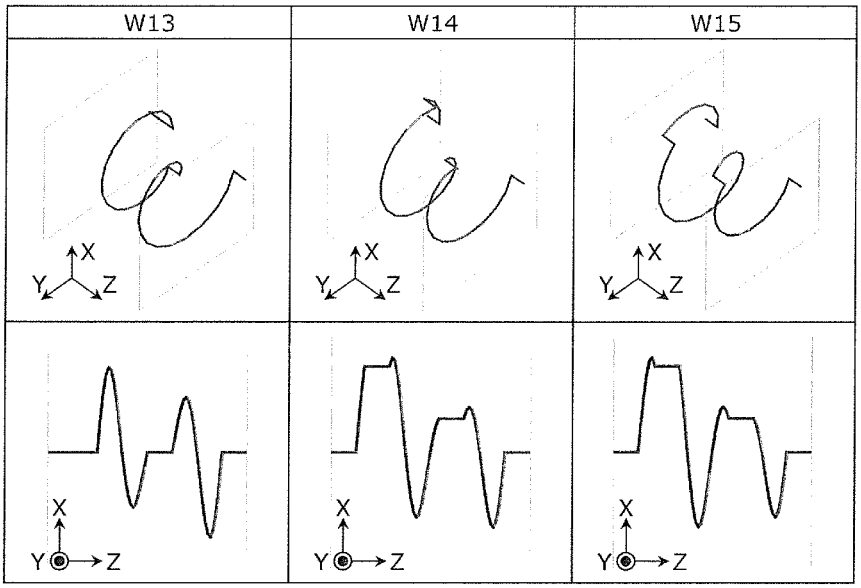
FIG. 5E includes perspective views and side views of examples of the wire shapes according to Embodiment 1.
Figure 5F:
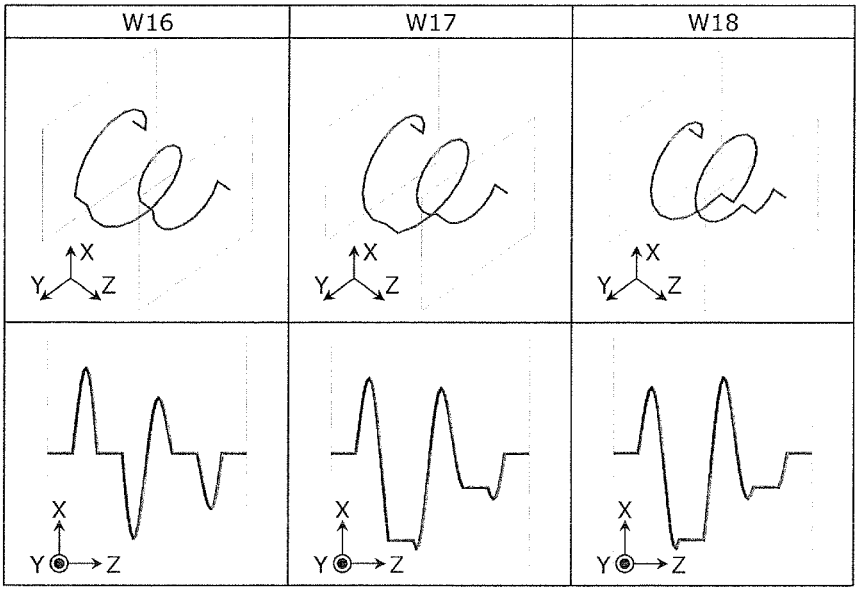
FIG. 5F includes perspective views and side views of examples of the wire shapes according to Embodiment 1.

FIG. 3 and FIG. 4 are a side view and a front view of a specific example of the shapes of the wires 100.

Each wire 100 includes a first leader 111, an outer-winding helical portion 102, an outer circumference connection portion 103, an inner-winding helical portion 104, an inner circumference connection portion 105, and a second leader 121. The outer-winding helical portion 102, the outer circumference connection portion 103, the inner-winding helical portion 104, and the inner circumference connection portion 105 are collectively referred to as a wire body 101.

The first leader 111 is a straight portion extending in the axial direction, and connects the first electrode 110 and the wire body 101 to each other.

The second leader 121 is a straight portion extending in the axial direction, and connects the wire body and the second electrode 120 to each other.

The first leader 111 and the second leader 121 are collectively referred to as leaders.

The outer-winding helical portion 102 is a portion that shifts in the axial direction while gradually increasing its diameter. The outer-winding helical portion 102 of the wire W1 makes one turn about an axis while shifting in the axial direction from an inner circumferential end where Z=0 to an outer circumferential end where Z=a. The outer-winding helical portion 102 may shift, for example, by a/6 in the axial direction while rotating 60° about an axis.

That the outer-winding helical portion 102 shifts in the axial direction while gradually increasing its diameter means that the outer-winding helical portion 102 has no section where it shifts in the axial direction without increasing its diameter at all or no section where it further rapidly increases its diameter than in other sections. This may be defined that, for example, the diameter of the outer-winding helical portion 102 increases at a substantially constant ratio with respect to the shift in the axial direction in any appropriate section of the outer-winding helical portion 102.

The inner-winding helical portion 104 is a portion that shifts in the axial direction while gradually reducing its diameter. The inner-winding helical portion 104 of the wire W1 makes one turn around the axis while shifting in the axial direction from the outer circumferential end where Z=3a/2 to the inner circumferential end where Z=5a/2. The inner-winding helical portion 104 may shift, for example, by a/6 in the axial direction while rotating 60° about the axis.

That the inner-winding helical portion 104 shifts in the axial direction while gradually reducing its diameter means that the inner-winding helical portion 104 has no section where it shifts in the axial direction without reducing its diameter at all or no section where it further rapidly reduces its diameter than in other sections. This may be defined that, for example, the diameter of the inner-winding helical portion 104 decreases at a substantially constant ratio with respect to the shift in the axial direction in any appropriate section of the inner-winding helical portion 104.

The outer circumference connection portion 103 is a portion that connects the outer circumferential end of the outer-winding helical portion 102 and the outer circumferential end of the inner-winding helical portion 104 at different positions in the axial direction. The outer circumference connection portion 103 of the wire W1 is a straight portion extending in the axial direction, and connects the outer circumferential end of the outer-winding helical portion 102 where Z=a and the outer circumferential end of the inner-winding helical portion 104 where Z=3a/2 to each other.

The inner circumference connection portion 105 is a portion that connects the inner circumferential end of the inner-winding helical portion 104 and the inner circumferential end of the outer-winding helical portion 102 to each other. Since the wire W1 has no outer-winding helical portion 102 disposed subsequent to the inner-winding helical portion 104, the inner circumference connection portion 105 connects the inner circumferential end of the inner-winding helical portion 104 and the second leader 121 to each other.

Here, the outer circumference connection portion 103 and the inner circumference connection portion 105 are examples of connection portions that connect the end of the outer-winding helical portion and the end of the inner-winding helical portion at different positions in the axial direction. However, the connection portion located at the end of the wire body 101 in the axial direction (for example, the inner circumference connection portions 105 of the wires W1 and W2) connects the leader and either of the end of the outer-winding helical portion 102 or the end of the inner-winding helical portion 104 to each other.

The axial length of a portion of the outer-winding helical portion 102 that makes one turn around the axis and the axial length of a portion of the inner-winding helical portion 104 that makes one turn around the axis are both a first length a. A second length b, which is the axial length of the outer circumference connection portion 103, is half the first length a, that is, a/2.

This characteristic shape of the wire W1 is also applied to the wires W2 to W18.

For example, the wire W2 has a shape where it, with respect to the wire W1, rotates 60° about the axis, shifts in parallel by a/6 in the axial direction, and shifts in parallel the inner circumference connection portion 105, which protrudes beyond the terminal end of the original wire (that is, Z>3a), to the leading end.

Similarly, each of the wires W3 to W18 has a shape where it, with respect to the corresponding one of the wires W2 to W17, rotates 60° about the axis, shifts in parallel by a/6 in the axial direction, and shifts the trailing end portion that protrudes beyond the terminal end of the original wire (that is, Z>3a) to the leading end.

FIG. 5A to FIG. 5F illustrate examples of the shapes of the wires W1 to W18 in the perspective views (upper halves) and the side views (lower halves). Combining all the wires W1 to W18 forms the inductor 1 illustrated in FIG. 1.

Thus, in the inductor 1, multiple wires each having the outer-winding helical portion, the connection portion, and the inner-winding helical portion are sequentially shifted by rotation about the axis, by parallel shift in the axial direction, and by shifting the trailing end portion to the leading end.

Thus, the outer-winding helical portions of the multiple wires are arranged in the radial direction so as not to touch each other, and the inner-winding helical portions of the multiple wires are arranged in the radial direction so as not to touch each other. Thus, the connection portions prevent the outer-winding helical portion of each wire and the inner-winding helical portion of another wire from touching each other. Thus, an inductor can be formed by arranging multiple wires having substantially the same shape.

Uniformizing the wire shape not only uniformizes the full length of the wires, but also uniformizes the ratio in length between the portions of each wire in the radial direction at the inner circumference, the middle portion, and the outer circumference. Thus, the electric characteristics between the wires are effectively uniformized Thus, an imbalance in current distribution in the wires is reduced, and a low-loss inductor can be obtained.

(Arrangement of Wires)

Subsequently, an arrangement of the wires 100 in the inductor 1 will be described.

Figure 6:
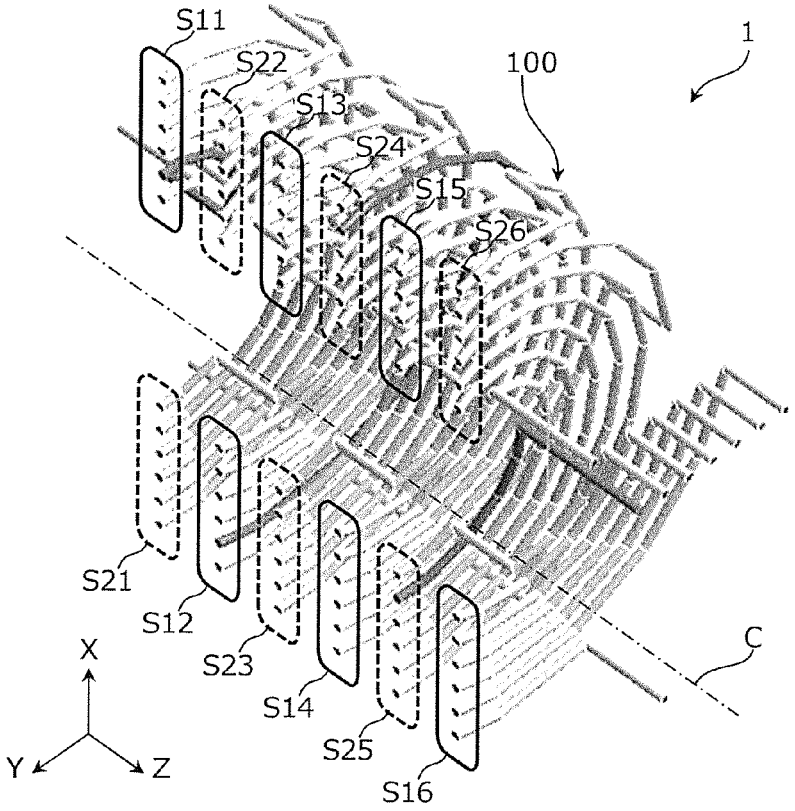
FIG. 6 is a partially cut perspective view of an example of an arrangement of the wires according to Embodiment 1.

FIG. 6 is a partially cut perspective view of an example of an arrangement of the wires 100 in the inductor 1.

Figure 7:
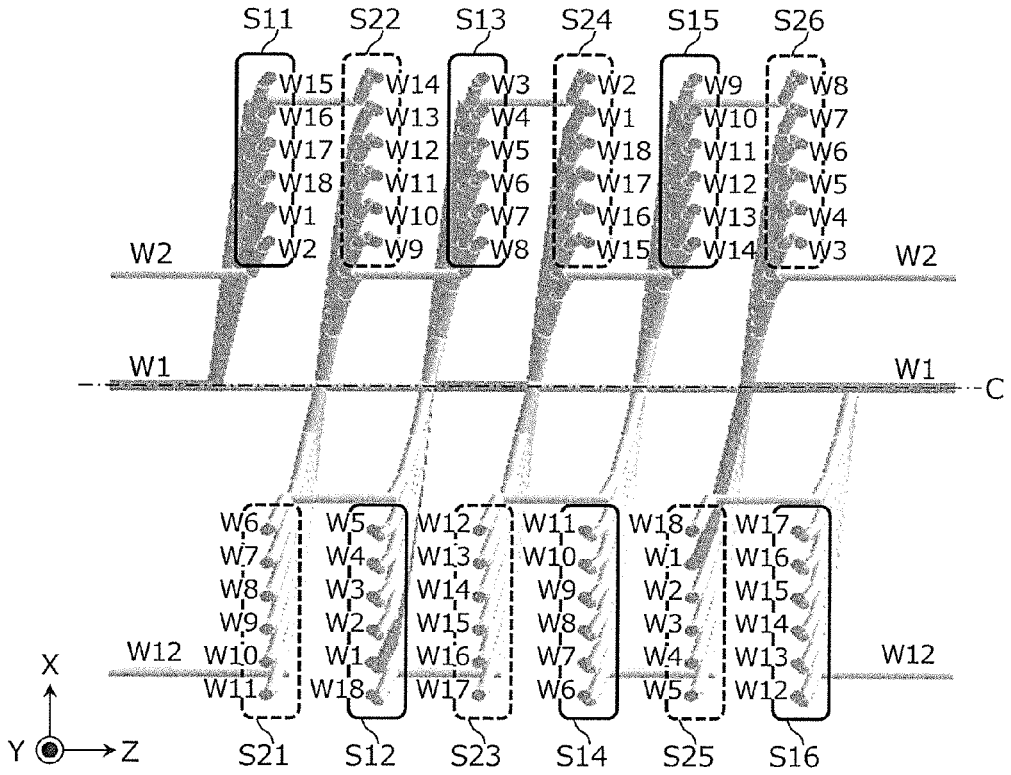
FIG. 7 is a cross-sectional view of an example of an arrangement of the wires according to Embodiment 1.

FIG. 7 is a cross-sectional view of the cross section in FIG. 6, and illustrates the wires W1 to W18 in the cross section with reference signs used in FIG. 2.

FIG. 6 and FIG. 7 illustrate cross sections S11 to S16 at the outer-winding helical portions of the wires 100 in solid-line frames, and illustrate cross sections S21 to S26 at the inner-winding helical portions of the wires 100 in broken-line frames.

As illustrated in FIG. 7, in the cross sections S11 to S16, the outer-winding helical portions of the wires are arranged in ascending order of the reference signs from the outer circumference to the inner circumference. In the cross sections S21 to S26, the inner-winding helical portions of the wires are arranged in ascending order of the reference signs from the inner circumference to the outer circumference. Here, the ascending order of the reference signs denotes a cyclical ascending order that defines the relationship of W18<W1 for the reference signs at both ends.

FIG. 8A to FIG. 8F are front views of an example of an arrangement of the wires 100 in FIG. 6 and FIG. 7 in more detail. In FIG. 8A to FIG. 8F, thick lines denote wires, black dots denote the outer circumference connection portions and start points of the inner circumference connection portions (front end points in the axial direction), and hollow dots denote the outer circumference connection portions and end points of the inner circumference connection portions (far end points in the axial direction). In FIG. 8A to FIG. 8F, the Z coordinates of the dots in the same positions in the radial direction are denoted as being the same. However, this is merely for the convenience of understanding. Not all the points at the same position in the radial direction need to have the same Z coordinate. Unless the wires touch each other, the wires may be shifted from each other.

Figure 8A:
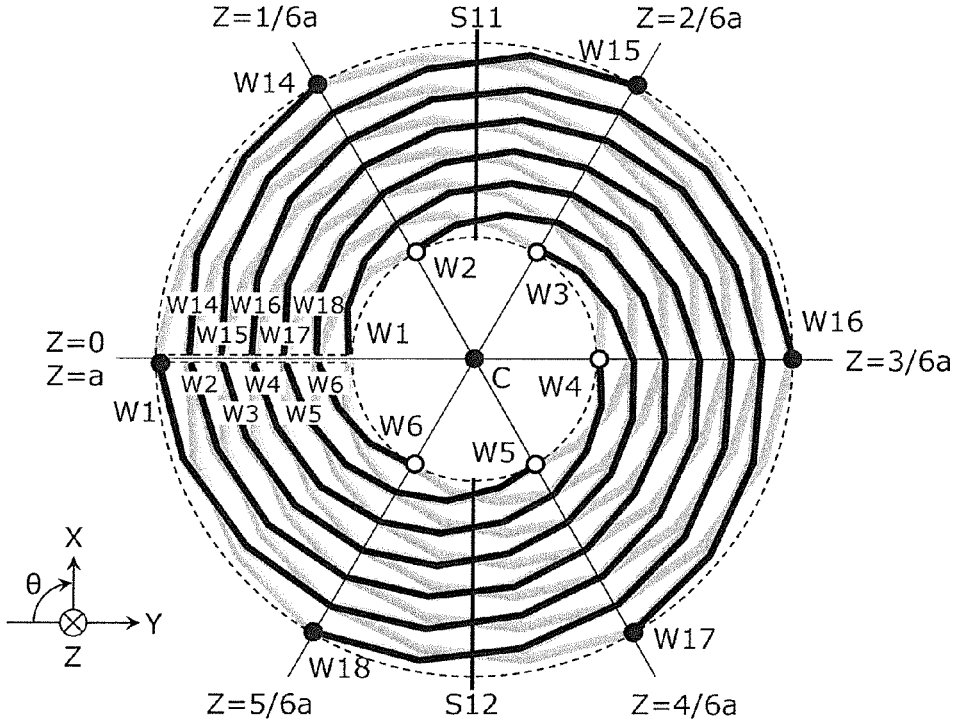
FIG. 8A is a front view of an example of an arrangement of the wires according to Embodiment 1.

FIG. 8A illustrates the outer-winding helical portions within the range of $0 \leq Z \leq a$ in the axial direction.

In the range of $0° \leq \theta \leq 60°$ in the radial direction, the outer-winding helical portions of the wires W14, W15, W16, W17, W18, and W1 are arranged in this order from the outer circumference to the inner circumference.

The outer-winding helical portions of the wires W14, W15, W16, W17, W18, and W1 shift in the circumferential direction and the axial direction while gradually increasing their diameters. At 60° in the radial direction, the outer-winding helical portion of the wire W14 arrives at the outer circumferential end, and is connected to the inner-winding helical portion (FIG. 8B) of the wire W14 with the outer circumference connection portion interposed therebetween. At the emptied inner circumferential end, the outer-winding helical portion of the wire W2 connected from the inner circumference connection portion is disposed.

In the range of 60°≤θ≤120° in the radial direction, the outer-winding helical portions of the wires W15, W16, W17, W18, W1, and W2 are arranged in this order from the outer circumference to the inner circumference.

The outer-winding helical portions of the wires W15, W16, W17, W18, W1, and W2 shift in the circumferential direction and the axial direction while gradually increasing their diameters. At 120° in the radial direction, the outer-winding helical portion of the wire W15 arrives at the outer circumferential end, and is connected to the inner-winding helical portion (FIG. 8B) of the wire W15 with the outer circumference connection portion interposed therebetween. At the emptied inner circumferential end, the outer-winding helical portion of the wire W3 connected from the inner circumference connection portion is disposed.

In the range of 120°≤θ≤180° in the radial direction, the outer-winding helical portions of the wires W16, W17, W18, W1, W2, and W3 are arranged in this order from the outer circumference to the inner circumference. Similarly, the outer-winding helical portions of the subsequent wires are arranged in this manner.

In the example illustrated in FIG. 8A, the outer-winding helical portions of six of the multiple wires are arranged in the radial direction, and six wires are cyclically switched between a first side and a second side of each connection portion in the circumferential direction (that is, both areas circumferentially surrounding a radius on which each connection portion is positioned).

Figure 8B:
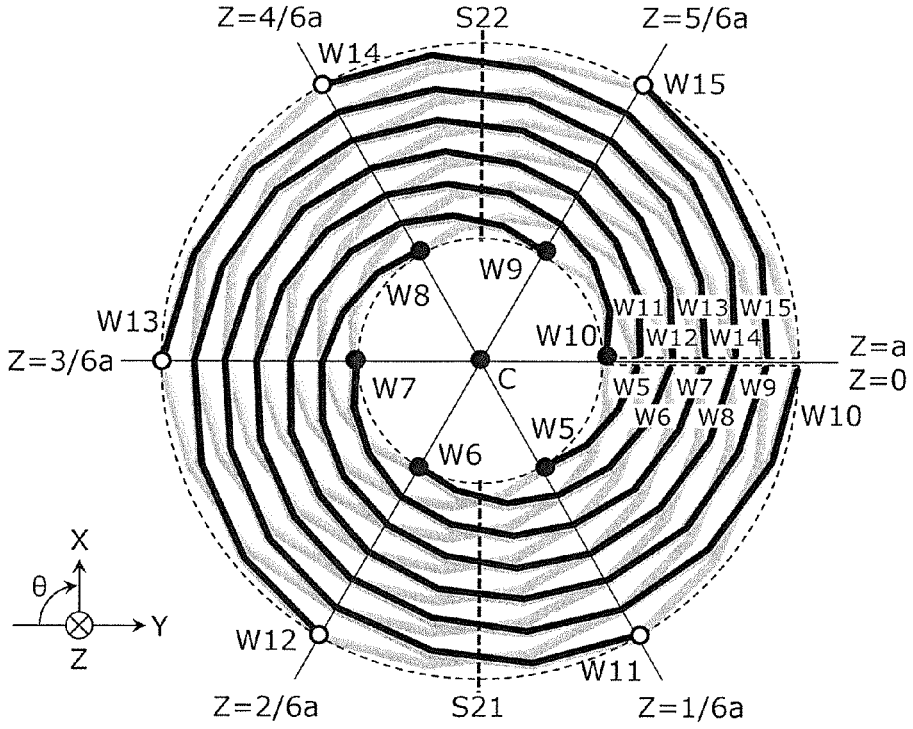
FIG. 8B is a front view of an example of an arrangement of the wires according to Embodiment 1.

FIG. 8B illustrates the inner-winding helical portions located within the range of 0≤Z≤a in the axial direction.

In the range of 180°≤θ≤240° in the radial direction, the inner-winding helical portions of the wires W5, W6, W7, W8, W9, and W10 are arranged in this order from the inner circumference to the outer circumference.

The inner-winding helical portions of the wires W5, W6, W7, W8, W9, and W10 shift in the circumferential direction and the axial direction while gradually reducing their diameters. At 240° in the radial direction, the inner-winding helical portion of the wire W5 arrives at the inner circumferential end, and is connected to the outer-winding helical portion (FIG. 8A) of the wire W5 with the inner circumference connection portion interposed therebetween. At the emptied outer circumferential end, the inner-winding helical portion of the wire W11 connected from the outer circumference connection portion is disposed.

In the range of 240°≤θ≤300° in the radial direction, the inner-winding helical portions of the wires W6, W7, W8, W9, W10, and W11 are arranged in this order from the inner circumference to the outer circumference.

The inner-winding helical portions of the wires W6, W7, W8, W9, W10, and W11 shift in the circumferential direction and the axial direction while gradually reducing their diameters. At 300° in the radial direction, the inner-winding helical portion of the wire W6 arrives at the inner circumferential end, and is connected to the outer-winding helical portion (FIG. 8A) of the wire W6 with the inner circumference connection portion interposed therebetween. At the emptied outer circumferential end, the inner-winding helical portion of the wire W12 connected from the outer circumference connection portion is disposed.

In the range of 300°≤θ≤360° in the radial direction, the inner-winding helical portions of the wires W7, W8, W9, W10, W11, and W12 are arranged in this order from the inner circumference to the outer circumference. Similarly, the inner-winding helical portions of the subsequent wires are arranged in this manner.

In the example illustrated in FIG. 8B, the inner-winding helical portions of six of the multiple wires are arranged in the radial direction, and six wires are cyclically switched between a first side and a second side of each connection portion in the circumferential direction (that is, both areas circumferentially surrounding a radius on which each connection portion is positioned).

Figure 8C:
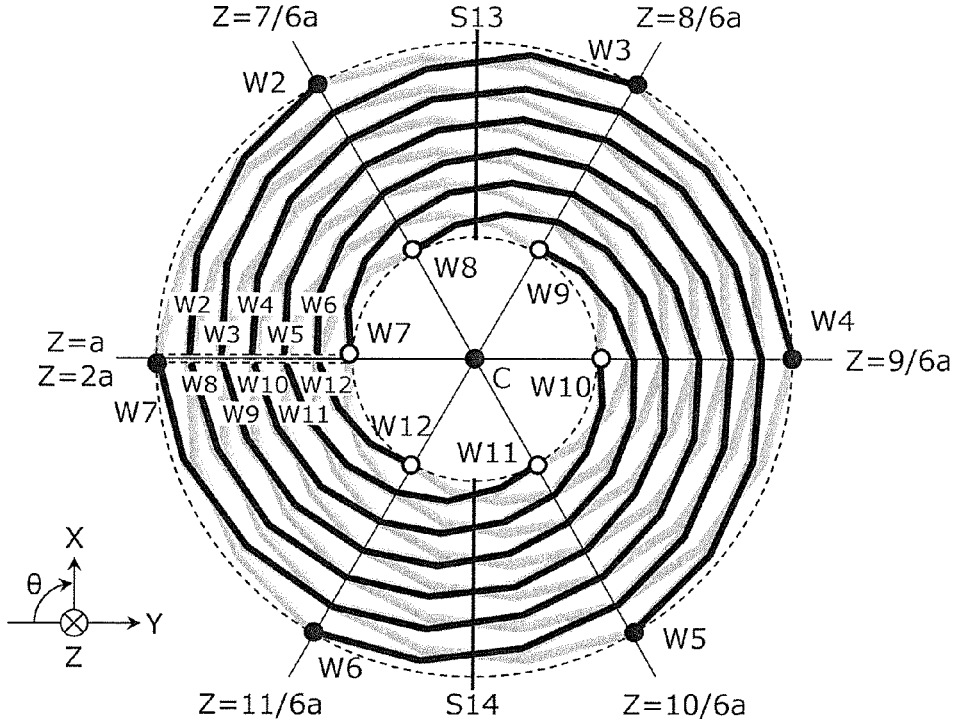
FIG. 8C is a front view of an example of an arrangement of the wires according to Embodiment 1.
Figure 8D:
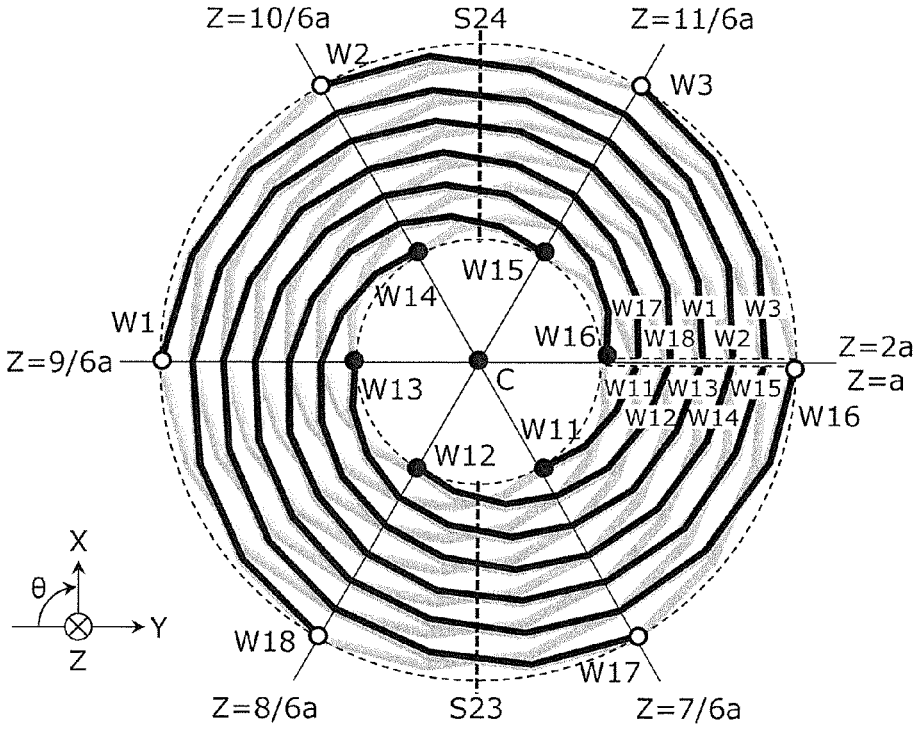
FIG. 8D is a front view of an example of an arrangement of the wires according to Embodiment 1.

FIG. 8C and FIG. 8D respectively illustrate the outer-winding helical portions and the inner-winding helical portions within the range of a≤Z≤2a in the axial direction.

Figure 8E:
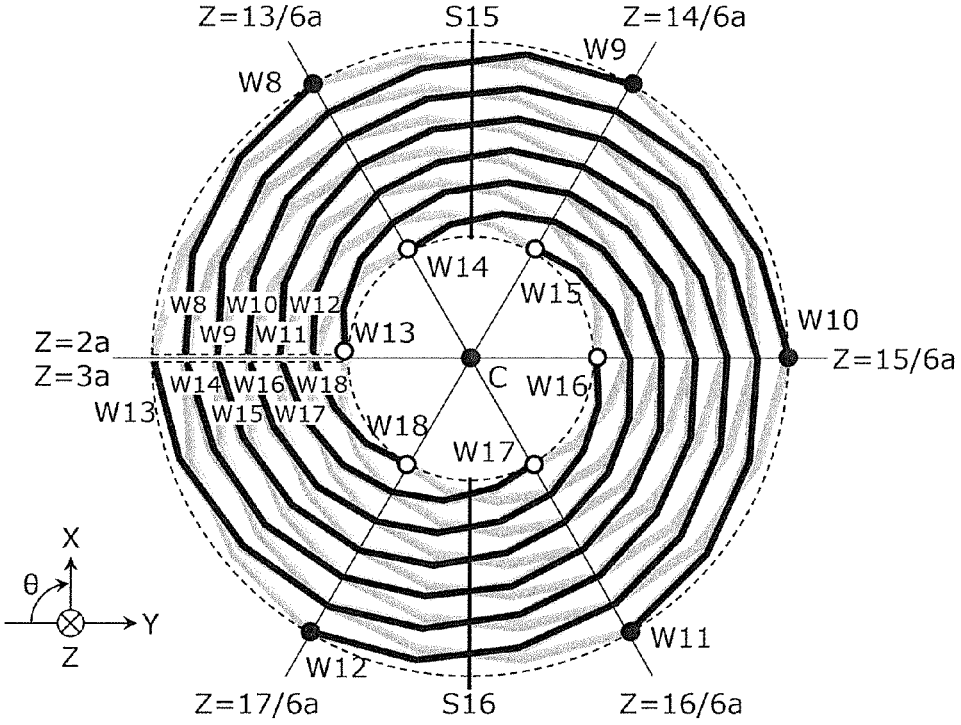
FIG. 8E is a front view of an example of an arrangement of the wires according to Embodiment 1.
Figure 8F:
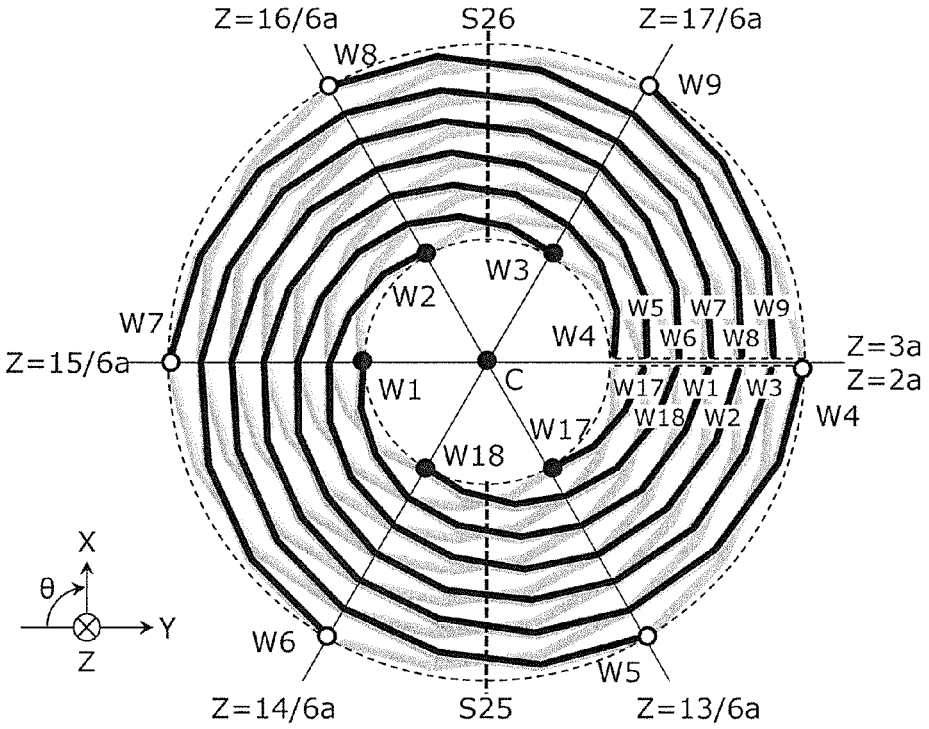
FIG. 8F is a front view of an example of an arrangement of the wires according to Embodiment 1.

FIG. 8E and FIG. 8F illustrate the outer-winding helical portions and the inner-winding helical portions within the range of 2a≤Z≤3a in the axial direction.

As illustrated in FIG. 8A to FIG. 8F, in the entire inductor 1, the outer-winding helical portions of a predetermined number of wires among the multiple wires are arranged in the radial direction, and a predetermined number of wires of the multiple wires are cyclically switched between a first side and a second side of each connection portion in the circumferential direction. The inner-winding helical portions of a predetermined number of wires among the multiple wires are arranged in the radial direction, and a predetermined number of wires of the multiple wires are cyclically switched between a first side and a second side of each connection portion in the circumferential direction.

Thus, all the wires extend through the inner circumference, the middle portion, and the outer circumference in the radial direction without an imbalance. Thus, the wires have effectively uniformized electric characteristics, and improve the wire arrangement density. Thus, an imbalance in current distribution in the wires is reduced, so that a small-sized and low-loss inductor can be obtained.

Embodiment 2

An inductor according to Embodiment 2 differs from the inductor 1 according to Embodiment 1 in the detail of the wire structure. Hereinbelow, description of the matters the same as those in Embodiment 1 is omitted as appropriate, and the features of the inductor according to Embodiment 2 will be mainly described.

(Shape of Wires)

Figure 9:
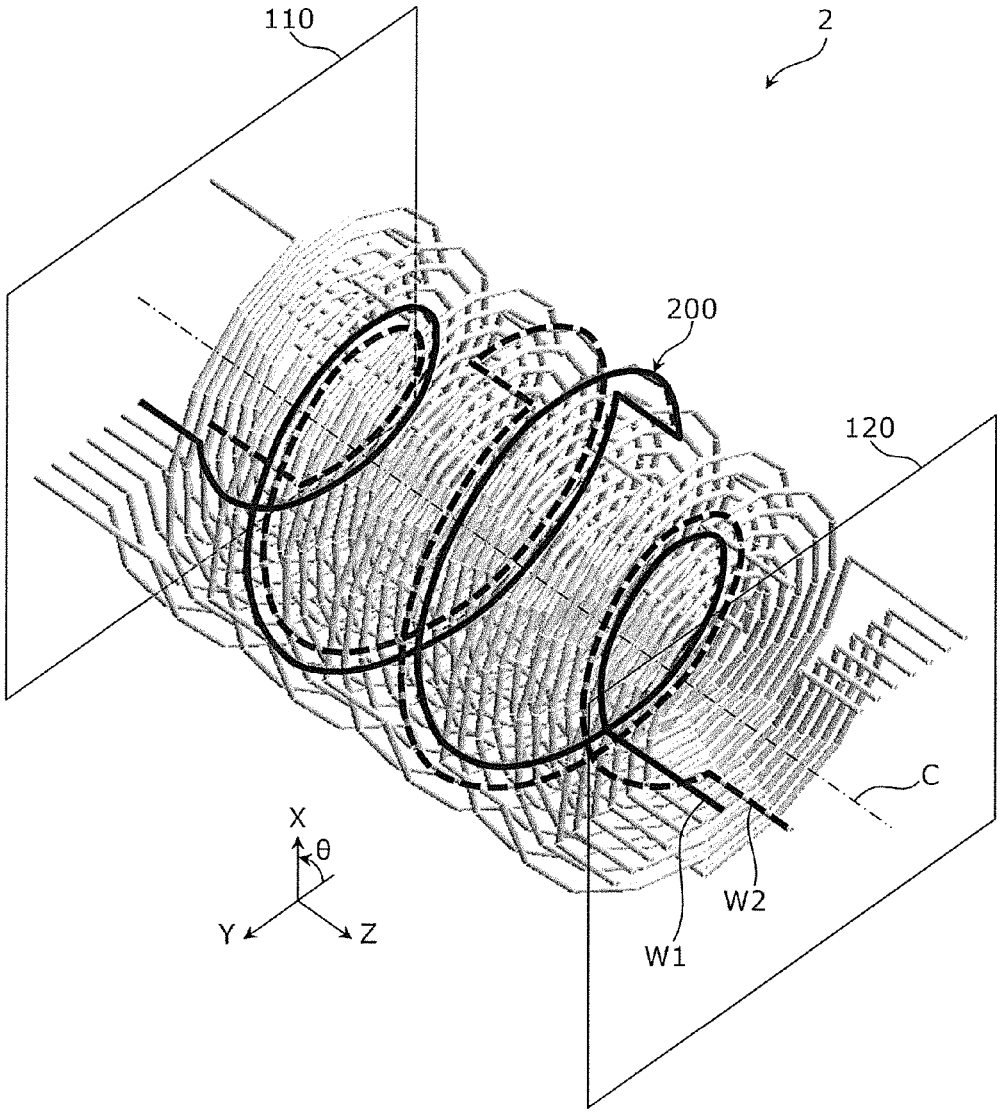
FIG. 9 is a perspective view of an example of the shapes of wires according to Embodiment 2.

FIG. 9 is a perspective view of an example of the shape of wires included in the inductor according to Embodiment 2.

As illustrated in FIG. 9, an inductor 2 includes multiple wires 200, a first electrode 110, and a second electrode 120. The multiple wires 200 are disposed about the axis C. The first electrode 110 is connected to a first end of each of the multiple wires 200. The second electrode 120 is connected to a second end of each of the multiple wires 200. Thus, the inductor 2 forms a two-terminal inductor element.

As an example of the dimensions of the inductor 2, the wire width is 2 μm, the pitch in the radial direction is 6 μm, the pitch in the axial direction is 20 μm, and the coil diameter is 120 μm. The number of wires 200 is 16, and each wire 200 has three turns.

FIG. 9 illustrates the wires W1 and W2 with a thick solid line and a thick broken line for exaggeration, respectively, to clarify the specific examples of the shapes.

Figure 10:
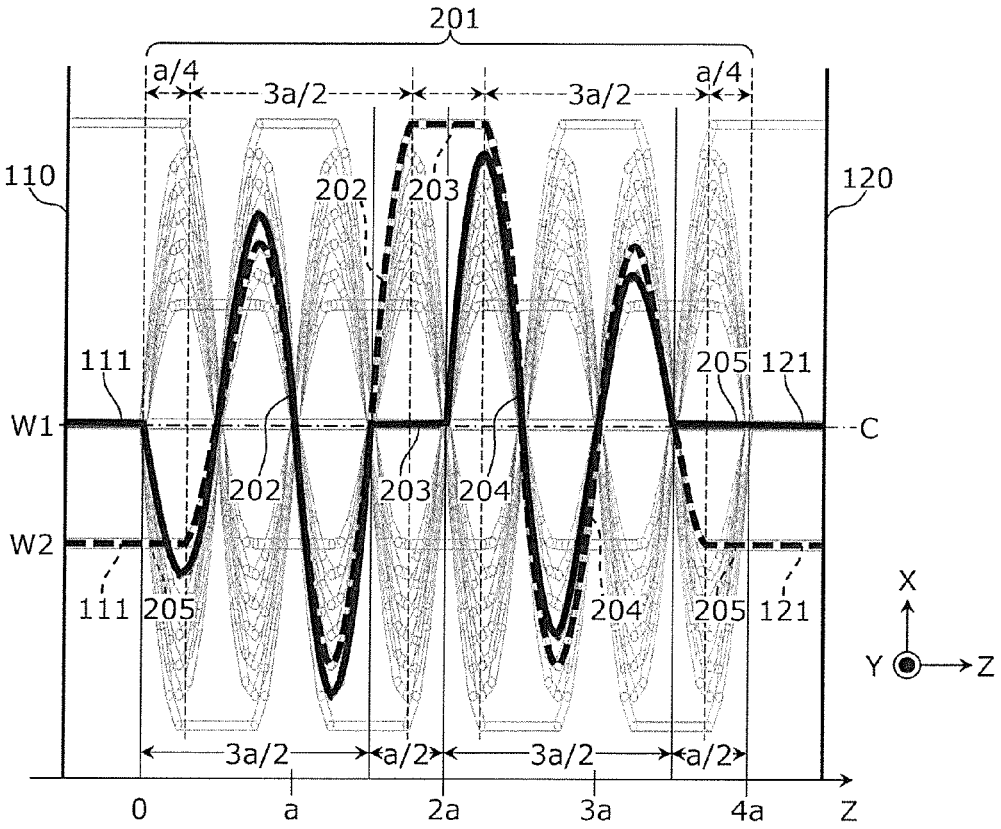
FIG. 10 is a side view of an example of the shapes of wires according to Embodiment 2.
Figure 11:
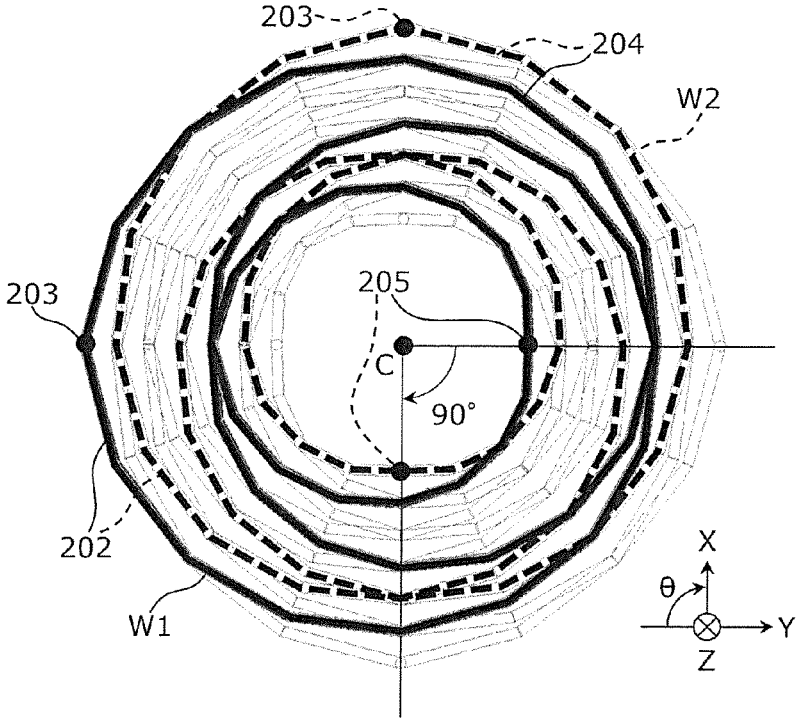
FIG. 11 is a front view of an example of the shapes of the wires according to Embodiment 2.

FIG. 10 and FIG. 11 are a side view and a front view of a specific example of the shapes of the wires 200.

Each wire 200 includes a first leader 111, an outer-winding helical portion 202, an outer circumference connection portion 203, an inner-winding helical portion 204, an inner circumference connection portion 205, and a second leader 121. The outer-winding helical portion 202, the outer circumference connection portion 203, the inner-winding helical portion 204, and the inner circumference connection portion 205 are collectively referred to as a wire body 201.

The outer-winding helical portion 202 is a portion that shifts in the axial direction while gradually increasing the diameter. The outer-winding helical portion 202 of the wire W1 makes 1.5 turns about the axis while shifting in the axial direction from the inner circumferential end where Z=0 to the outer circumferential end where Z=3a/2. The outer-winding helical portion 202 may shift, for example, a/4 in the axial direction while rotating 90° about the axis.

That the outer-winding helical portion 202 shifts in the axial direction while gradually increasing its diameter means that the outer-winding helical portion 202 has no section where it shifts in the axial direction without increasing its diameter at all or no section where it further rapidly increases its diameter than in other sections. This may be defined that, for example, the diameter of the outer-winding helical portion 202 increases at a substantially constant ratio with respect to the shift in the axial direction in any appropriate section of the outer-winding helical portion 202.

The inner-winding helical portion 204 is a portion that shifts in the axial direction while gradually reducing its diameter. The inner-winding helical portion 204 of the wire W1 makes 1.5 turns around the axis while shifting in the axial direction from the outer circumferential end where Z=2a to the inner circumferential end where Z=7a/2. The inner-winding helical portion 204 may shift, for example, by a/4 in the axial direction while rotating 90° about the axis.

That the inner-winding helical portion 204 shifts in the axial direction while gradually reducing its diameter means that the inner-winding helical portion 204 has no section where it shifts in the axial direction without reducing its diameter at all or no section where it further rapidly reduces its diameter than in other sections. This may be defined that, for example, the diameter of the inner-winding helical portion 204 decreases at a substantially constant ratio with respect to the shift in the axial direction in any appropriate section of the inner-winding helical portion 204.

The outer circumference connection portion 203 is a portion that connects the outer circumferential end of the outer-winding helical portion 202 and the outer circumferential end of the inner-winding helical portion 204 at different positions in the axial direction. The outer circumference connection portion 203 of the wire W1 is a straight portion extending in the axial direction, and connects the outer circumferential end of the outer-winding helical portion 202 where Z=3a/2 and the outer circumferential end of the inner-winding helical portion 204 where Z=2a to each other.

The inner circumference connection portion 205 is a portion that connects the inner circumferential end of the inner-winding helical portion 204 and the inner circumferential end of the outer-winding helical portion 202 to each other. The wire W1 has no outer-winding helical portion 202 disposed subsequent to the inner-winding helical portion 204. Thus, the inner circumference connection portion 205 connects the inner circumferential end of the inner-winding helical portion 204 and the second leader 121 to each other.

Here, the outer circumference connection portion 203 and the inner circumference connection portion 205 are examples of connection portions that connect the end of the outer-winding helical portion and the end of the inner-winding helical portion at different positions in the axial direction. However, the connection portion located at the end of the wire body 201 in the axial direction (for example, the inner circumference connection portions 205 of the wires W1 and W2) connects the leader and either the end of the outer-winding helical portion 202 or the end of the inner-winding helical portion 204 to each other.

The axial length of a portion of the outer-winding helical portion 202 that makes one turn around the axis and the axial length of a portion of the inner-winding helical portion 204 that makes one turn around the axis are both a first length a. A second length b, which is the axial length of the outer circumference connection portion 203 is half the first length a, that is, a/2.

This characteristic shape of the wire W1 is also applied to the wires W2 to W16.

For example, the wire W2 has a shape where it, with respect to the wire W1, rotates 90° about the axis, shifts in parallel by a/4 in the axial direction, and shifts the inner circumference connection portion 205, which protrudes beyond the terminal end of the original wire (that is, Z>4a), to the leading end.

Similarly, each of the wires W3 to W16 has a shape where it, with respect to the corresponding one of the wires W2 to W15, rotates 90° about the axis, shifts in parallel by a/4 in the axial direction, and shifts the trailing end portion that protrudes beyond the terminal end of the original wire (that is, Z>4a) to the leading end.

Thus, as in the case of the inductor 1, in the inductor 2, multiple wires each having the outer-winding helical portion, the connection portion, and the inner-winding helical portion are sequentially shifted by rotation about the axis, by parallel shift in the axial direction, and by shifting the trailing end portion to the leading end.

Thus, the outer-winding helical portions of the multiple wires are arranged in the radial direction so as not to touch each other, and the inner-winding helical portions of the multiple wires are arranged in the radial direction so as not to touch each other. Thus, the connection portions prevent the outer-winding helical portion of each wire and the inner-winding helical portion of another wire from touching each other. Thus, an inductor can be formed by arranging multiple wires having substantially the same shape.

Uniformizing the wire shape not only uniformizes the full length of the wires, but also uniformizes the ratio in length between the portions of each wire in the radial direction at the inner circumference, the middle portion, and the outer circumference. Thus, the electric characteristics between the wires are effectively uniformized Thus, an imbalance in current distribution in the wires is reduced, and a low-loss inductor can be obtained.

Embodiment 3

An inductor according to Embodiment 3 differs from the inductor 1 according to Embodiment 1 in the detail of the wire structure. Hereinbelow, description of the matters the same as those in Embodiment 1 is omitted as appropriate, and the features of the inductor according to Embodiment 3 will be mainly described.

(Shape of Wires)

Figure 12:
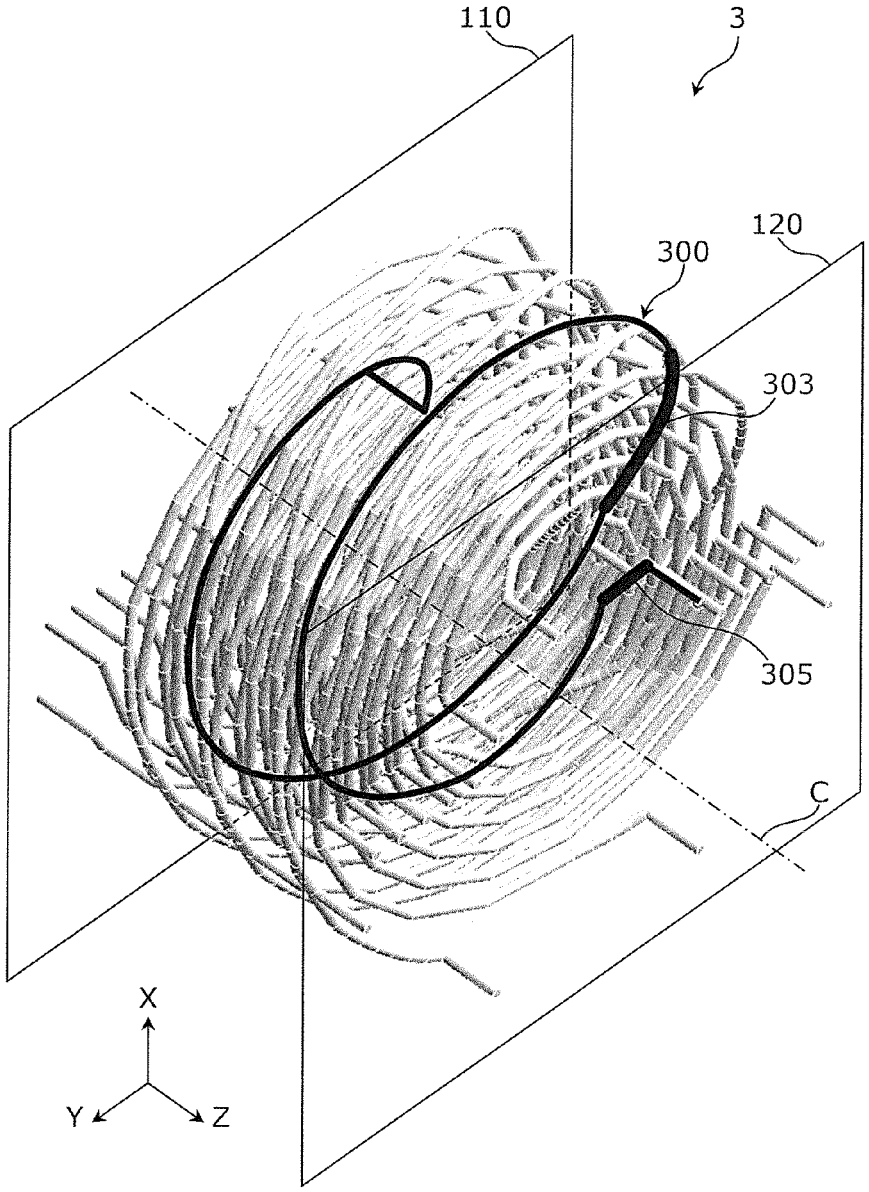
FIG. 12 is a perspective view of an example of the shapes of wires according to Embodiment 3.

FIG. 12 is a perspective view of an example of the shape of wires included in the inductor according to Embodiment 3.

As illustrated in FIG. 12, an inductor 3 includes multiple wires 300, a first electrode 110, and a second electrode 120.

The multiple wires 300 are disposed about the axis C. The first electrode 110 is connected to a first end of each of the multiple wires 300. The second electrode 120 is connected to a second end of each of the multiple wires 300. Thus, the inductor 3 forms a two-terminal inductor element.

As an example of the dimensions of the inductor 3, the wire width is 2 μm, the pitch in the radial direction is 6 μm, the pitch in the axial direction is 6 μm, and the coil diameter is 120 μm. The number of wires 300 is 18, and each wire 300 has two turns.

FIG. 12 illustrates the wire W1 with a thick solid line for exaggeration to clarify the specific example of the shape.

Figure 13:
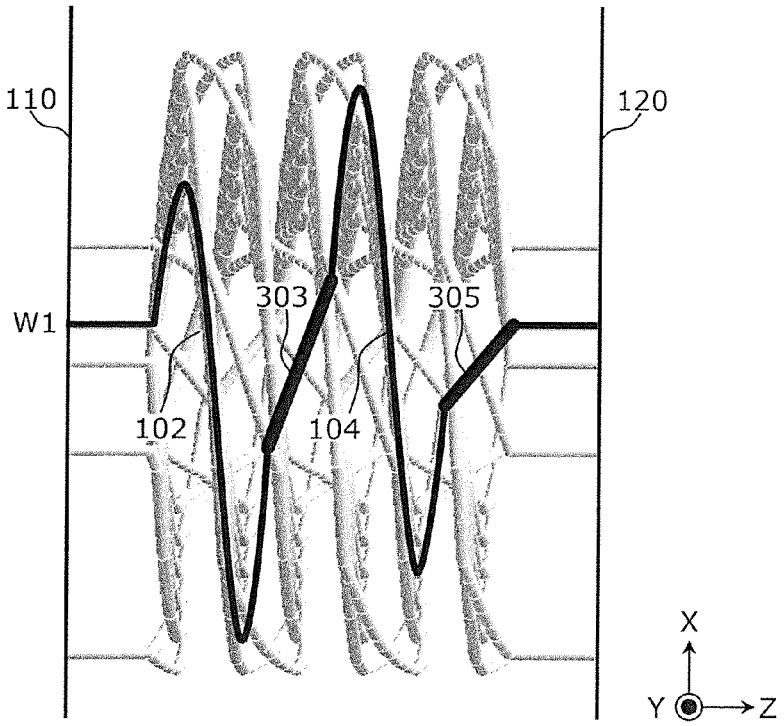
FIG. 13 is a side view of an example of the shapes of the wires according to Embodiment 3.
Figure 14:
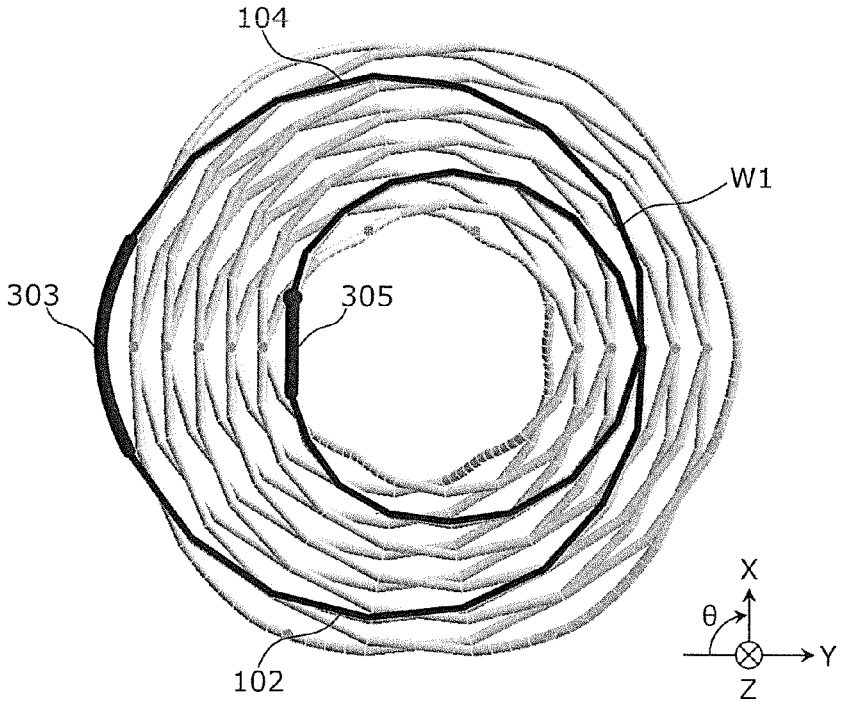
FIG. 14 is a front view of an example of the shapes of the wires according to Embodiment 3.

FIG. 13 and FIG. 14 are a side view and a front view of a specific example of the shapes of the wires 300.

Each wire 300 is formed by changing the outer circumference connection portion 103 and the inner circumference connection portion 105 of the wire 100 illustrated in FIG. 2 to an outer circumference connection portion 303 and an inner circumference connection portion 305.

The outer circumference connection portion 303 connects the outer circumferential end of the outer-winding helical portion 102 and the outer circumferential end of the inner-winding helical portion 104 at different positions in the circumferential direction. The outer circumference connection portion 303 may be a smooth curve.

The inner circumference connection portion 305 connects the inner circumferential end of the inner-winding helical portion 104 and the inner circumferential end of the outer-winding helical portion 102 at different positions in the circumferential direction. The inner circumference connection portion 305 may be a smooth curve.

The shape of each wire 300 can increase an angle formed in the wire 300 at a connection point between the outer circumference connection portion 303 and each of the outer circumferential end of the outer-winding helical portion 102 and the outer circumferential end of the inner-winding helical portion 104. The shape of each wire 300 can increase an angle formed in the wire 300 at a connection point between the inner circumference connection portion 305 and each of the inner circumferential end of the inner-winding helical portion 104 and the inner circumferential end of the outer-winding helical portion 102. This shape prevents each wire 300 from being sharply bent, and prevents an occurrence of a higher mode. Thus, a low-loss inductor having an efficient frequency response can be obtained.

Embodiment 4

An inductor according to Embodiment 4 differs from the inductor 1 according to Embodiment 1 in the detail of the wire structure. Hereinbelow, description of the matters the same as those in Embodiment 1 will be omitted as appropriate, and the features of the inductor according to Embodiment 4 will be mainly described.

(Shape of Wires)

Figure 15:
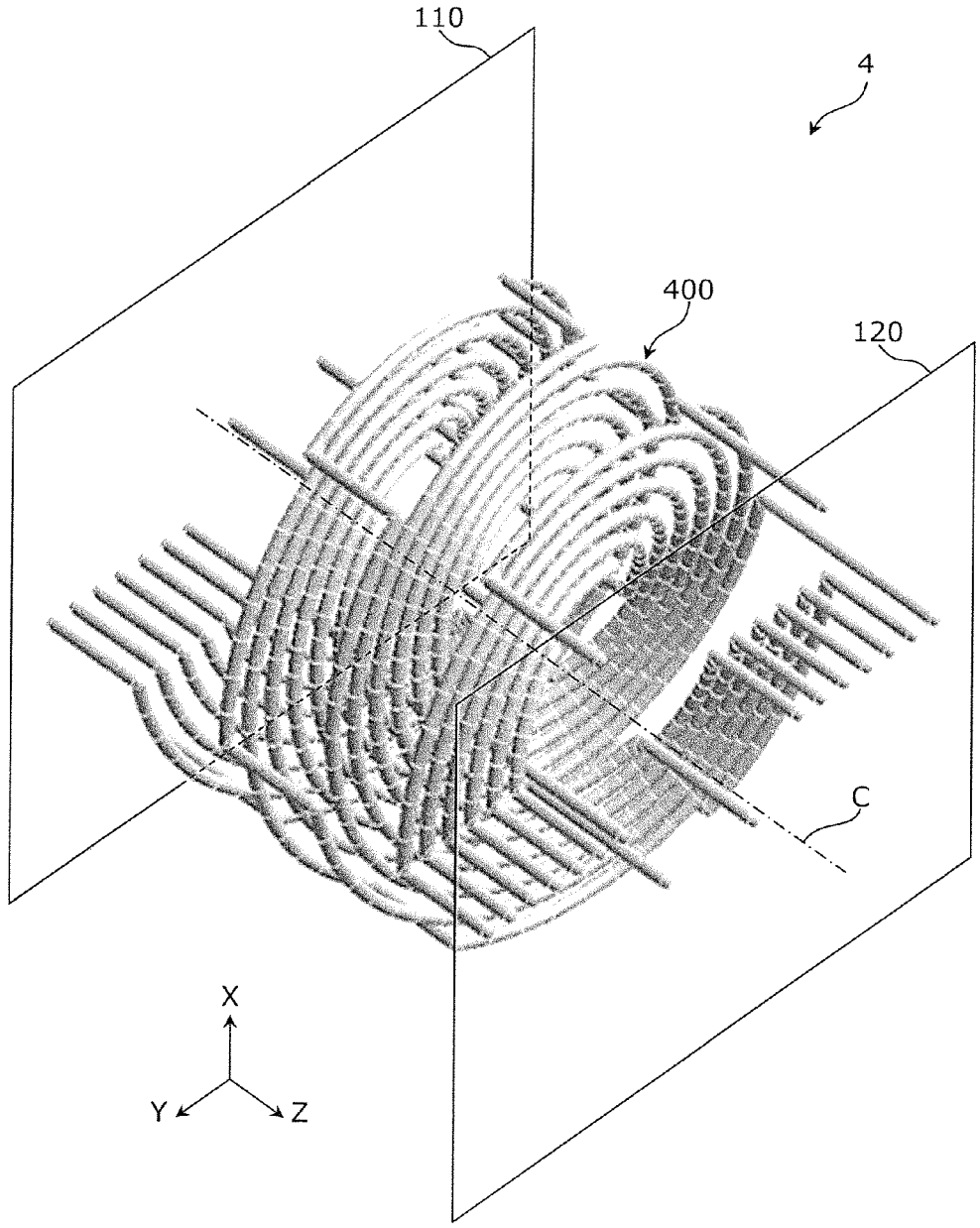
FIG. 15 is a perspective view of an example of the shapes of wires according to Embodiment 4.

FIG. 15 is a perspective view of an example of the shape of wires included in the inductor according to Embodiment 4.

As illustrated in FIG. 15, an inductor 4 includes multiple wires 400, a first electrode 110, and a second electrode 120. The multiple wires 400 are formed from rounded smooth (for example, a polygonal line shape with more nodes) wiring conductors.

Embodiment 5

An inductor according to Embodiment 5 differs from the inductor 1 according to Embodiment 1 in the detail of the wire structure. Hereinbelow, description of the matters the same as those in Embodiment 1 is omitted as appropriate, and the features of the inductor according to Embodiment 5 will be mainly described.

(Shape of Wires)

Figure 16:
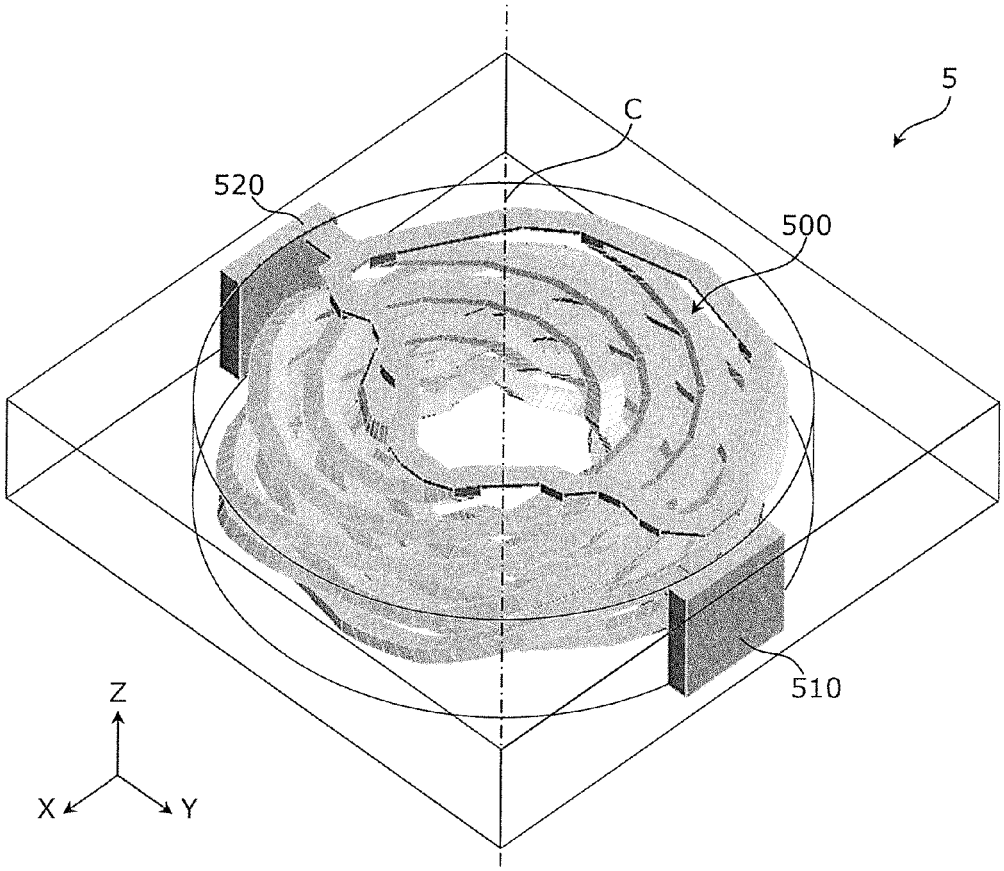
FIG. 16 is a perspective view of an example of the shapes of wires according to Embodiment 5.

FIG. 16 is a perspective view of an example of the shape of wires included in the inductor according to Embodiment 5.

As illustrated in FIG. 16, an inductor 5 includes multiple wires 500, a first electrode 510, and a second electrode 520.

Figure 17:
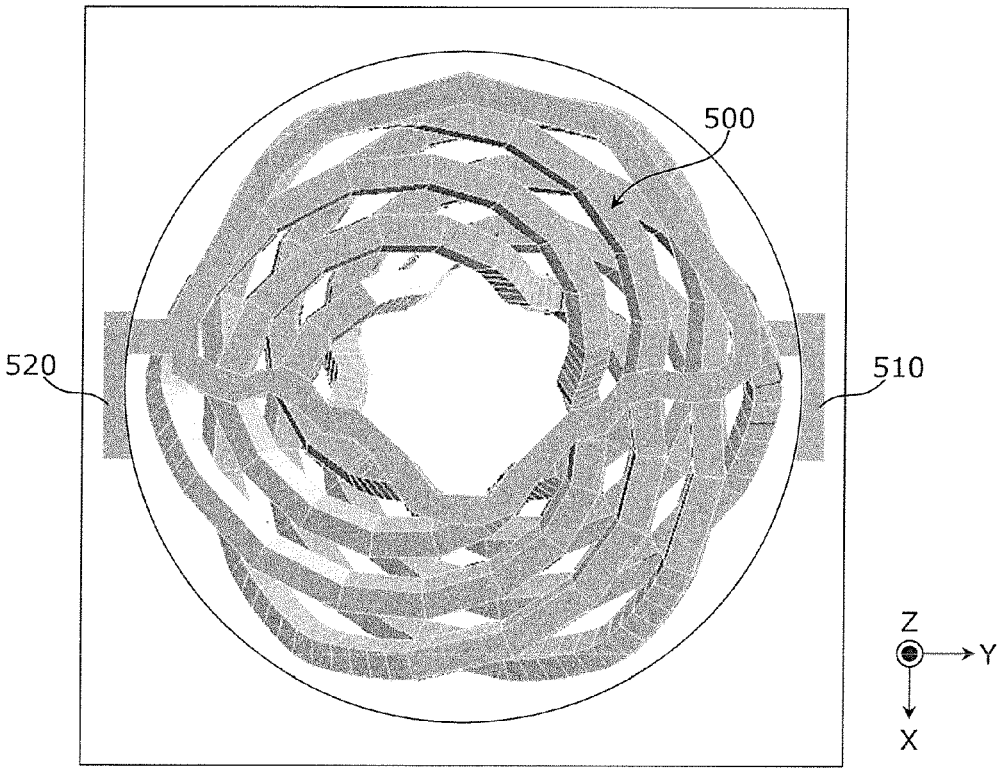
FIG. 17 is a front view of an example of the shapes of the wires according to Embodiment 5.
Figure 18:
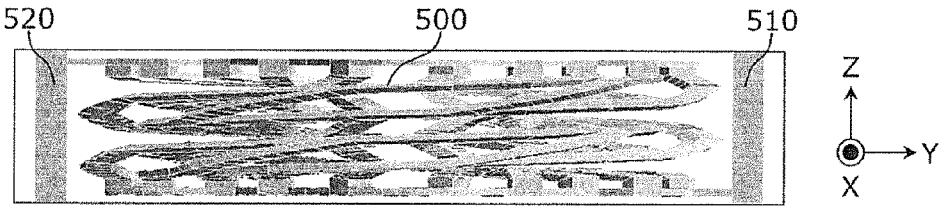
FIG. 18 is a side view of an example of the shapes of the wires according to Embodiment 5.

FIG. 17 and FIG. 18 are a side view and a front view of a specific example of the shapes of the wires 500.

The multiple wires 500 are formed from plate-shaped wiring conductors, and the first electrode 510 and the second electrode 520 are disposed on side surfaces (X and Z surfaces).

With this structure, an inductor element with a low height can be obtained. In addition, using thin wiring conductors can reduce the skin effect on high-frequency signals.

Embodiment 6

In Embodiment 6, results of inspection through simulations on an imbalance in current distribution between the wires in an inductor having the above-described wire structure will be described.

Figure 19A:
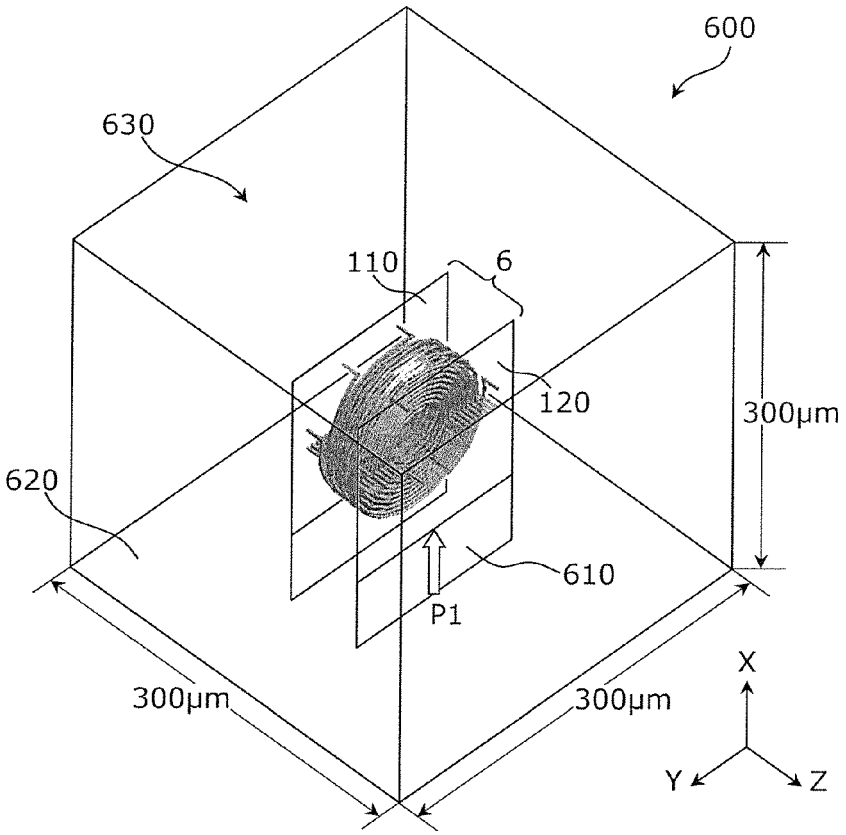
FIG. 19A is a perspective view of a simulation model according to Embodiment 6.
Figure 19B:
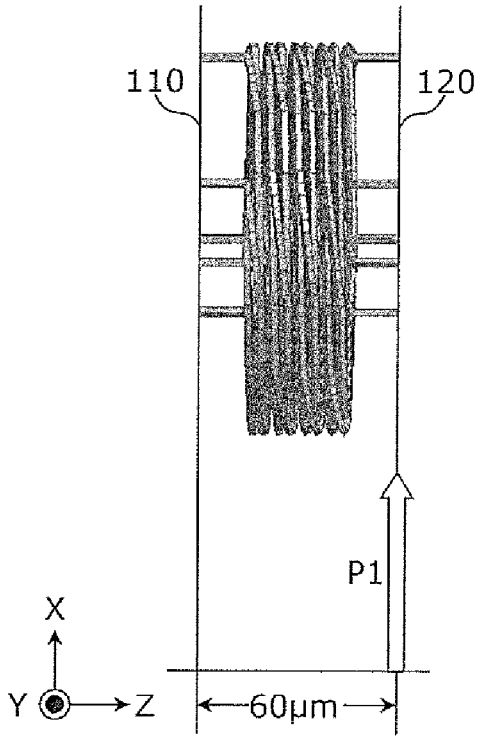
FIG. 19B is a side view of a simulation model according to Embodiment 6.
Figure 19C:
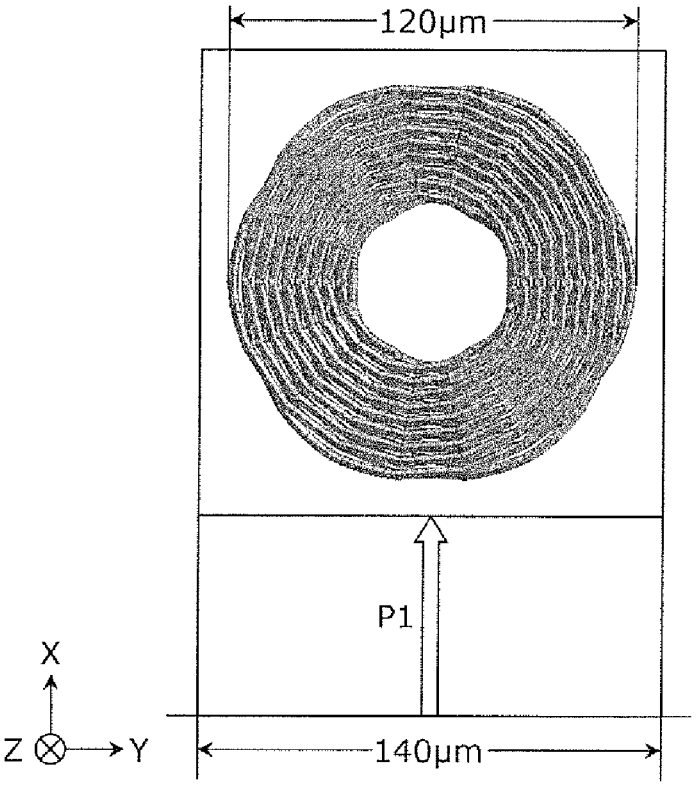
FIG. 19C is a front view of the simulation model according to Embodiment 6.

FIG. 19A, FIG. 19B, and FIG. 19C are a perspective view, a side view, and a front view, respectively, of a simulation model used for inspection.

As illustrated in FIG. 19A, FIG. 19B, and FIG. 19C, a simulation model 600 with its bottom surface formed from an electrically conductive earth electrode 620 and accommodating an inductor 6 in a cubic space 630 filled with air and having a side of 300 μm was formed.

The inductor 6 was formed by modifying the inductor 3 in the following manner. Specifically, the wire width was 2 μm, the pitch in the radial direction was 4 μm, the pitch in the axial direction was 4 μm, and the coil diameter was 120 μm. The number of wires was 18, and each wire had three turns.

A DC voltage P1 of 1 V was applied across a first electrode 110 and a second electrode 120 of the inductor 6 from a port 610 through the earth electrode 620.

Figure 20A:
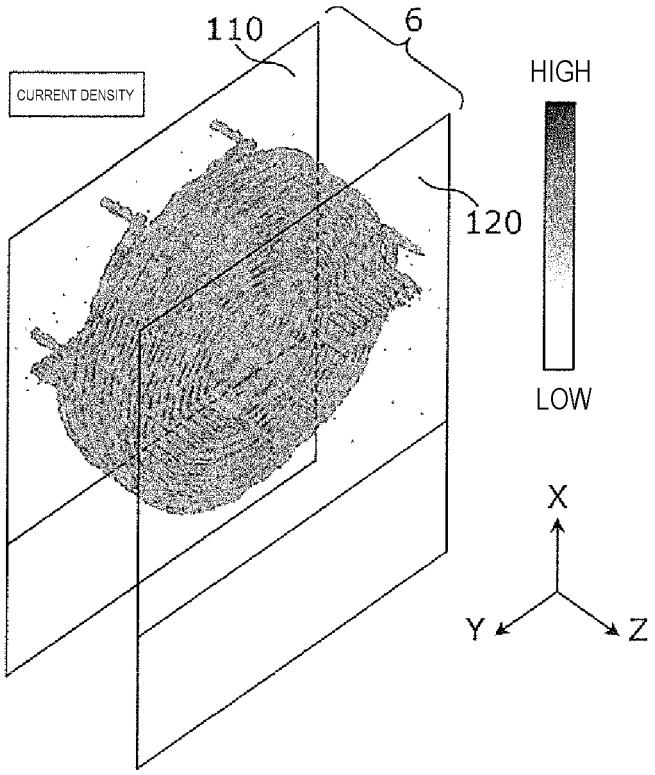
FIG. 20A is a perspective view of a simulation result according to Embodiment 6.

FIG. 20A is a perspective view of a simulation result for the electric current density.

Figure 20B:
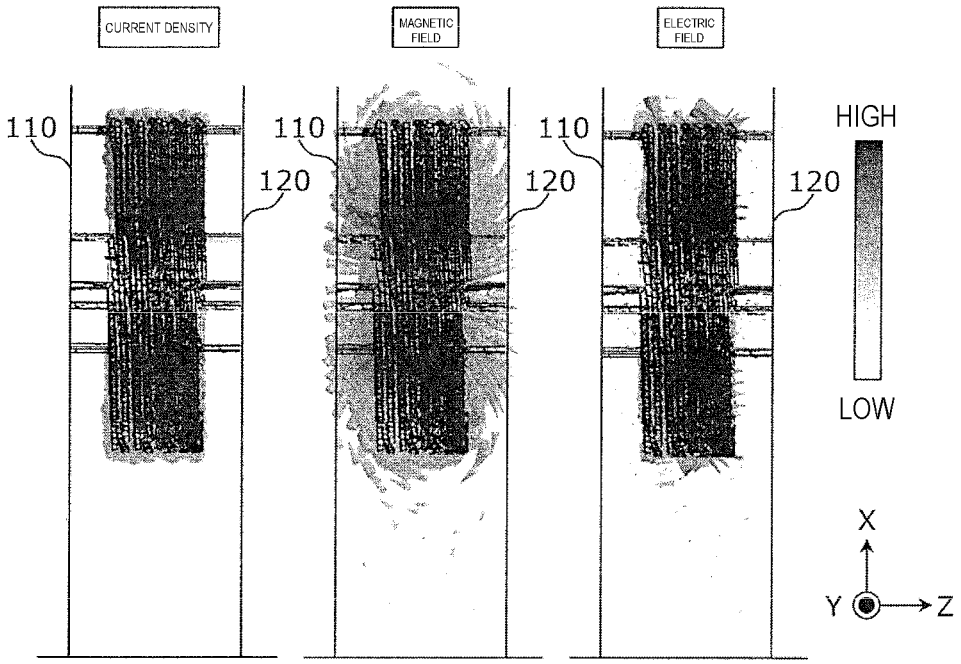
FIG. 20B is a side view of a simulation result according to Embodiment 6.

FIG. 20B is a side view of a simulation result for the electric current density, the magnetic field, and the electric field.

FIG. 20A and FIG. 20B illustrate that the electric current density is substantially uniform throughout the wires, and an intended result was obtained. The magnetic field and the electric field also caused preferable results without a large imbalance.

Embodiment 7

The above-described inductor enables size reduction and high-density arrangement of wires. Thus, the inductor is expected to obtain an extremely high Q-value with respect to high-frequency signals of an intended frequency. Thus, in Embodiment 7, how much Q-value is obtained by the inductor including smaller wires with respect to a high-frequency signal of 1 GHz was inspected.

Figure 21:
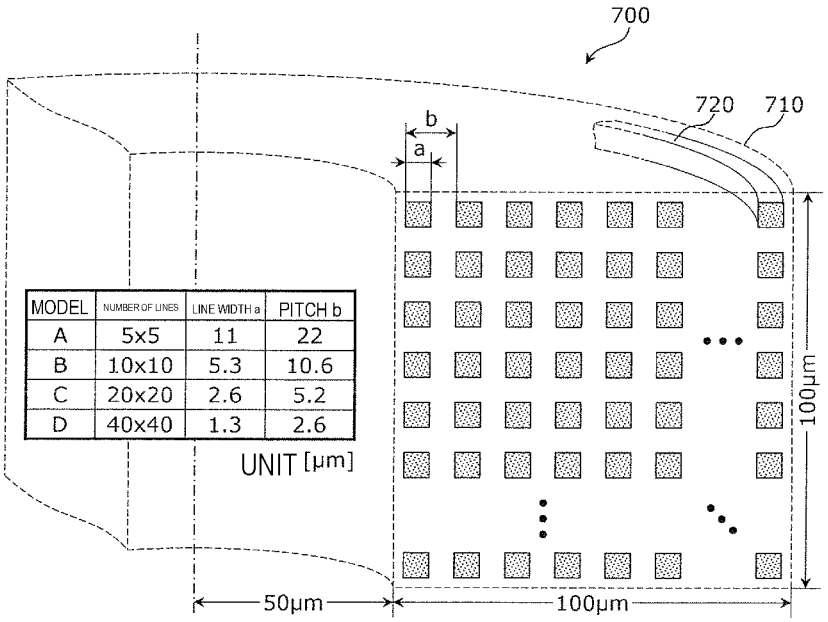
FIG. 21 is a perspective view of a simulation model according to Embodiment 7.

FIG. 21 is a perspective view of a simulation model used for inspection. As illustrated in FIG. 21, a simulation model 700 includes an annular wire area 710 with a square cross section with an inner diameter of 50 μm, an outer diameter of 100 μm, and a height of 100 μm, and a predetermined number of wiring conductors 720 with a line width a arranged at a pitch b. A space other than the wiring conductors is assumed to be filled with air, the dielectric constant is assumed to be 1, and the dielectric loss is assumed to be none. The wiring conductor 720 has an electric conductivity of $5.3\times10^7$ [S/m].

As illustrated in FIG. 21, four models A to D for the wiring conductor 720 that differ in the line width a, the pitch b, and the number were formed. For each model, the frequency response of a Q-value was obtained through a simulation in which a high-frequency signal of a variable frequency that causes 1 A in the entire wire area is applied.

Figure 22:
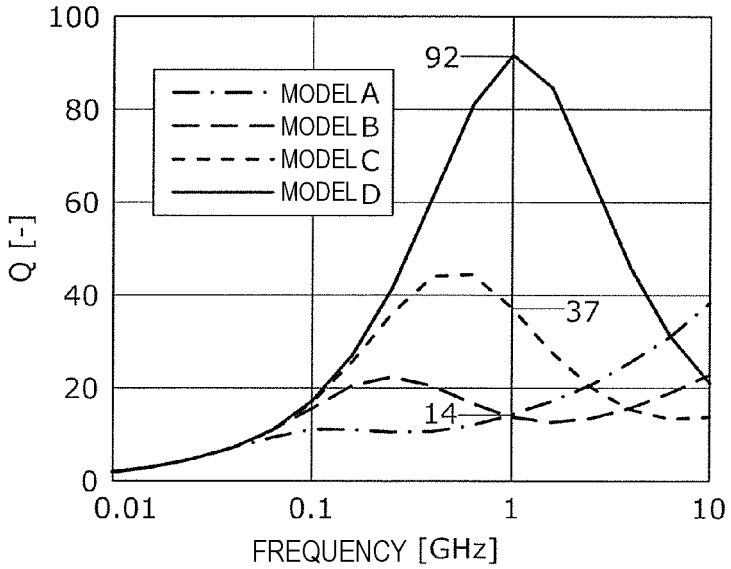
FIG. 22 is a graph showing a simulation result according to Embodiment 7.

FIG. 22 illustrates a simulation results for the frequency response of a Q-value. FIG. 22 reveals that a model D produces a high Q-value of 92 with respect to a high-frequency signal of 1 GHz.

For each model, electric current density viewed in a cross section of the wire area 710 and electric current density viewed in a cross section of one wiring conductor at the upper left end were obtained through a simulation where a high-frequency signal of 1 GHz that causes 1 A in the entire wire area is applied.

Figure 23:
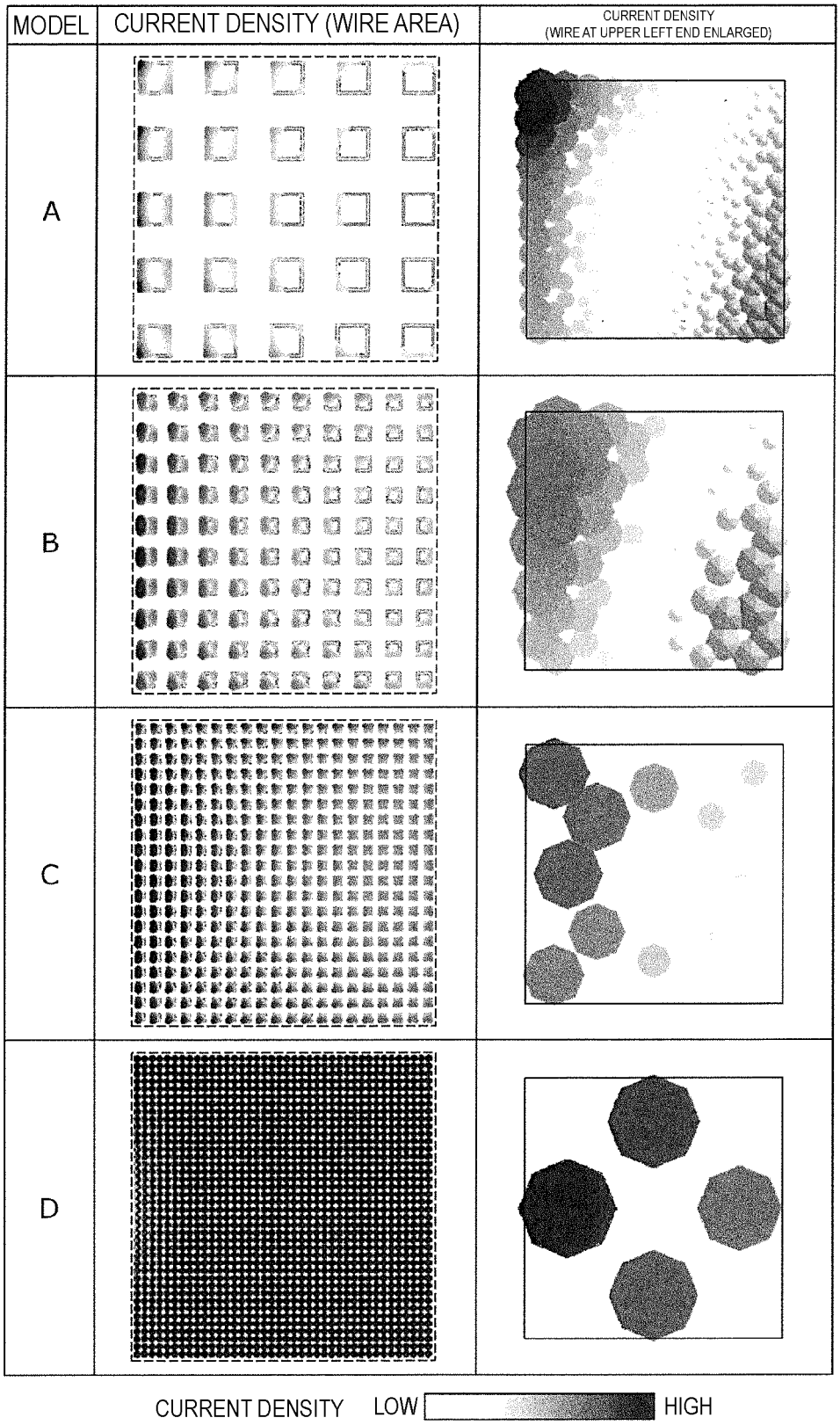
FIG. 23 illustrates the simulation result according to Embodiment 7.

FIG. 23 illustrates the simulation results. FIG. 23 reveals that in the models A, B, and C, the skin effect and the proximity effect are significant, and the distribution in the electric current density is largely imbalanced, whereas in the model D, the distribution in the electric current density is uniform and preferable.

Thus, the simulation results have confirmed that forming an inductor with a line width of 1.3 μm and a pitch of 2.6 μm based on the parameters of the model D is effective to obtain a preferable Q-value with respect to a high-frequency signal of 1 GHz.

Embodiment 8

In Embodiment 8, a transformer including multiple inductors, each being the inductor described above, magnetically coupled together will be described.

Figure 24:
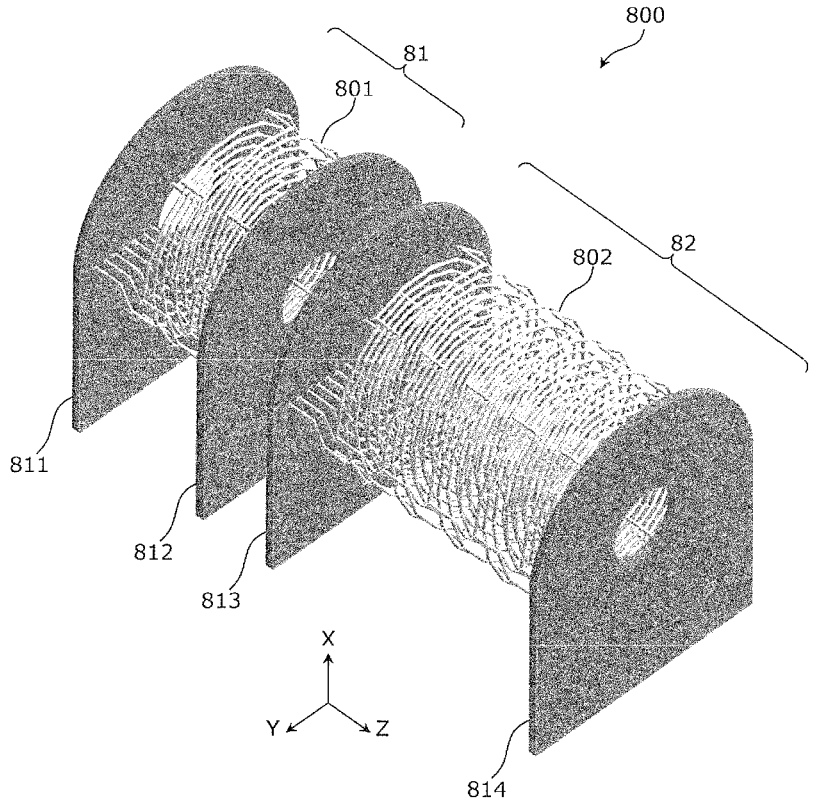
FIG. 24 is a perspective view of an example of a structure of a transformer according to Embodiment 8.
Figure 25:
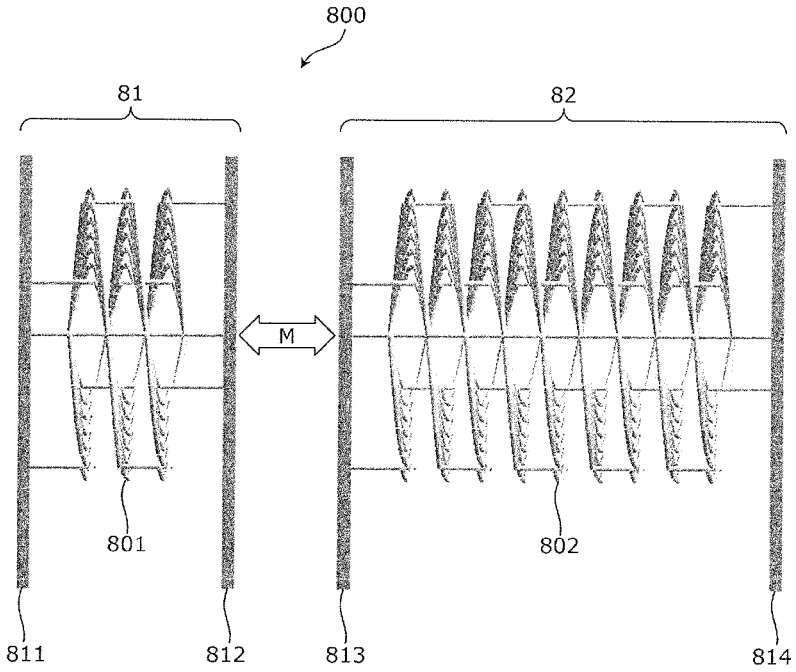
FIG. 25 is a side view of an example of a structure of the transformer according to Embodiment 8.

FIG. 24 and FIG. 25 are a perspective view and a side view of an example of a structure of a transformer according to Embodiment 8.

As illustrated in FIG. 24 and FIG. 25, a transformer 800 is formed by magnetically coupling inductors 81 and 82 (arrow M in FIG. 25). The inductor 81 includes multiple wires 801, a first electrode 811, and a second electrode 812. The inductor 82 includes multiple wires 802, a first electrode 813, and a second electrode 814. The inductors 81 and 82 are any of the above-described inductors.

A low-loss inductor that has reduced an imbalance in current distribution in the wires is used, and thus a low-loss and highly efficient transformer can be obtained.

Modification Examples

Thus far, inductors and transformers according to the embodiments of the present disclosure have been described. However, the present disclosure is not limited to these individual embodiments. Unless departing from the gist of the present disclosure, modifications of the embodiments conceived by a person having ordinary skill in the art and forms formed by combining components of different embodiments may also be included within one or more of embodiments of the present disclosure.

Summarization

As described above, an inductor according to an aspect of the present disclosure includes a plurality of wires disposed about an axis, a first electrode connected to a first end of each of the plurality of wires, and a second electrode connected to a second end of each of the multiple wires. Each of the plurality of wires includes an outer-winding helical portion that shifts in an axial direction while gradually increasing a diameter thereof, an inner-winding helical portion that shifts in the axial direction while gradually reducing a diameter thereof, and a connection portion that connects an end of the outer-winding helical portion and an end of the inner-winding helical portion at different positions in the axial direction.

The outer-winding helical portions of the multiple wires having such a shape are arranged in the radial direction so as not to touch each other, and the inner-winding helical portions of the multiple wires are arranged in the radial direction so as not to touch each other. Thus, the connection portions prevent the outer-winding helical portion of one wire and the inner-winding helical portion of another wire from touching each other. Thus, the inductor can be formed by arranging multiple wires having substantially the same shape. Uniformizing the wire shape not only uniformizes the full length of the wires, but also uniformizes the ratio in length between the portions of each wire in the radial direction at the inner circumference, the middle portion, and the outer circumference. Thus, the electric characteristics between the wires are effectively uniformized Thus, an imbalance in current distribution in the wires is reduced, and a low-loss inductor can be obtained.

The outer-winding helical portions of a predetermined number of wires among the multiple wires may be arranged in the radial direction, and the predetermined number of wires may be cyclically switched between a first side and a second side of each connection portion in the circumferential direction. The inner-winding helical portions of a predetermined number of wires among the multiple wires may be arranged in the radial direction, and the predetermined number of wires may be cyclically switched between a first side and a second side of each connection portion in the circumferential direction.

Thus, all the wires extend through the inner circumference, the middle portion, and the outer circumference in the radial direction without an imbalance. Thus, the wires have effectively uniformized electric characteristics, and improve the wire arrangement density. Thus, an imbalance in current distribution in the wires is reduced, so that a small-sized and low-loss inductor can be obtained.

The axial length of a portion of the outer-winding helical portion that makes one turn around the axis and the axial length of a portion of the inner-winding helical portion that makes one turn around the axis may both be a first length. A second length, which is the axial length of the connection portion, may be half the first length.

Thus, the outer-winding helical portions and the inner-winding helical portion are precisely equally arranged. Thus, the electric characteristics of the wires are effectively uniformized. The imbalance in current distribution in the wires is thus reduced, so that a low-loss inductor can be obtained.

The connection portions may connect an end of the outer-winding helical portion and an end of the inner-winding helical portion at different positions in a circumferential direction.

Thus, an angle formed in each wire at each of the connection points between the connection portion and the outer-winding helical portion and between the connection portion and the inner-winding helical portion can be increased to prevent an occurrence of a higher mode. Thus, a low-loss inductor with an efficient frequency response can be obtained.

The multiple wires may have congruent portions that overlap by rotation about the axis and parallel shift in the axial direction.

Thus, based on the geometrically congruence between the wires, a low-loss inductor that precisely removes an imbalance in current distribution in the wires can be obtained.

A transformer according to an aspect of the present disclosure is obtained by magnetically coupling multiple inductors each being the above-described inductor.

The transformer includes low-loss inductors that reduce an imbalance in current distribution in the wires, and thus a low-loss and highly efficient transformer can be obtained.

The present disclosure is widely usable in an electronic device, such as a personal digital assistant or a radio communication device, as an inductor and a transformer.

What is claimed is:

1. An inductor, comprising:

a plurality of wires disposed about an axis, each of the plurality of wires including an outer-winding helical portion shifting in an axial direction while gradually increasing a radius thereof, an inner-winding helical portion shifting in the axial direction while gradually reducing a radius thereof, and a connection portion that connects an end of the outer-winding helical portion and an end of the inner-winding helical portion at different positions in the axial direction;

a first electrode connected to a first end of each of the plurality of wires; and a second electrode connected to a second end of each of the plurality of wires.

2. The inductor according to claim 1, wherein the outer-winding helical portions of a predetermined number of wires among the plurality of wires are arranged in a radial direction, and the predetermined number of wires are cyclically switched between a first side and a second side of the connection portion in a circumferential direction, and the inner-winding helical portions of the predetermined number of wires among the plurality of wires are arranged in the radial direction, and the predetermined number of wires are cyclically switched between the first side and the second side of the connection portion in the circumferential direction.

3. The inductor according to claim 1, wherein an axial length of a portion of the outer-winding helical portion that makes one turn around the axis and an axial length of a portion of the inner-winding helical portion that makes one turn around the axis are both a first length, and a second length, which is an axial length of the connection portion, is half the first length.

4. The inductor according to claim 1, wherein the connection portion connects the end of the outer-winding helical portion and the end of the inner-winding helical portion at different positions around the axis.

5. The inductor according to claim 1, wherein the plurality of wires have congruent portions that overlap with each other with rotation about the axis and parallel shift in the axial direction.

6. A transformer, comprising a plurality of inductors, each being the inductor according to claim 1, magnetically coupled to each other.

7. The inductor according to claim 2, wherein an axial length of a portion of the outer-winding helical portion that makes one turn around the axis and an axial length of a portion of the inner-winding helical portion that makes one turn around the axis are both a first length, and a second length, which is an axial length of the connection portion, is half the first length.

8. The inductor according to claim 2, wherein the connection portion connects the end of the outer-winding helical portion and the end of the inner-winding helical portion at different positions around the axis.

9. The inductor according to claim 3, wherein the connection portion connects the end of the outer-winding helical portion and the end of the inner-winding helical portion at different positions around the axis.

10. The inductor according to claim 7, wherein the connection portion connects the end of the outer-winding helical portion and the end of the inner-winding helical portion at different positions around the axis.

11. The inductor according to claim 2, wherein the plurality of wires have congruent portions that overlap with each other with rotation about the axis and parallel shift in the axial direction.

12. The inductor according to claim 3, wherein the plurality of wires have congruent portions that overlap with each other with rotation about the axis and parallel shift in the axial direction.

13. The inductor according to claim 4, wherein the plurality of wires have congruent portions that overlap with each other with rotation about the axis and parallel shift in the axial direction.

14. The inductor according to claim 7, wherein the plurality of wires have congruent portions that overlap with each other with rotation about the axis and parallel shift in the axial direction.

15. The inductor according to claim 8, wherein the plurality of wires have congruent portions that overlap with each other with rotation about the axis and parallel shift in the axial direction.

16. A transformer, comprising a plurality of inductors, each being the inductor according to claim 2, magnetically coupled to each other.

17. A transformer, comprising a plurality of inductors, each being the inductor according to claim 3, magnetically coupled to each other.

18. A transformer, comprising a plurality of inductors, each being the inductor according to claim 4, magnetically coupled to each other.

19. A transformer, comprising a plurality of inductors, each being the inductor according to claim 5, magnetically coupled to each other.

20. A transformer, comprising a plurality of inductors, each being the inductor according to claim 7, magnetically coupled to each other.

* * * * *